US010878986B1

(12) United States Patent
Satou et al.

(10) Patent No.: US 10,878,986 B1
(45) Date of Patent: Dec. 29, 2020

(54) INDUCTOR

(71) Applicant: Murata Manufacturing Co., Ltd., Kyoto-fu (JP)

(72) Inventors: Yoshiharu Satou, Nagaokakyo (JP); Sumie Arai, Nagaokakyo (JP); Takuya Ishida, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/910,006

(22) Filed: Jun. 23, 2020

(30) Foreign Application Priority Data

Jun. 28, 2019 (JP) ..... 2019-120979

(51) Int. Cl.

| | |
|---|---|
| ***H01F 27/24*** | (2006.01) |
| ***H01F 17/04*** | (2006.01) |
| ***H01F 27/28*** | (2006.01) |
| ***H01F 27/255*** | (2006.01) |
| *H01F 27/06* | (2006.01) |
| *H01F 27/29* | (2006.01) |
| *H01F 27/30* | (2006.01) |

(52) U.S. Cl.
CPC ..... *H01F 17/045* (2013.01); *H01F 27/255* (2013.01); *H01F 27/2885* (2013.01); *H01F 27/06* (2013.01); *H01F 27/24* (2013.01); *H01F 27/29* (2013.01); *H01F 27/30* (2013.01)

(58) Field of Classification Search
CPC .. H01F 17/045; H01F 27/2885; H01F 27/255; H01F 27/24; H01F 27/29; H01F 27/06; H01F 27/30
See application file for complete search history.

(56) References Cited

U.S. PATENT DOCUMENTS

| | | | | |
|---|---|---|---|---|
| 8,723,629 | B1 * | 5/2014 | Liu | H01F 27/255 336/83 |
| 2009/0231077 | A1 * | 9/2009 | Liao | H01F 17/04 336/177 |
| 2012/0188040 | A1 * | 7/2012 | Ogawa | H01F 7/027 336/83 |

FOREIGN PATENT DOCUMENTS

| | | | |
|---|---|---|---|
| JP | 2007-165779 | A | 6/2007 |
| JP | 2013183052 | A * | 9/2013 |

* cited by examiner

*Primary Examiner* — Tuyen T Nguyen
(74) *Attorney, Agent, or Firm* — Studebaker & Brackett PC

(57) ABSTRACT

An inductor includes a body having a substantially rectangular parallelepiped shape and a pair of outer electrodes. The body includes a core having a base and a columnar portion formed on an upper surface of the base, includes a coil including a pair of extended portions and a wound portion having an upper stage portion and a lower stage portion, and includes a magnetic material containing magnetic powder and covering a part of the core, a part of the pair of extended portions, and the wound portion. The pair of outer electrodes are disposed on a mounting surface of the body and are connected to the pair of respective extended portions. A shape in plan view of the wound portion is hollow and a substantially circular shape having a short direction and a long direction, and the upper stage portion includes a protruding portion protruding in the short direction.

20 Claims, 7 Drawing Sheets

INDUCTOR

CROSS-REFERENCE TO RELATED APPLICATION

This application claims benefit of priority to Japanese Patent Application No. 2019-120979, filed Jun. 28, 2019, the entire content of which is incorporated herein by reference.

BACKGROUND

Technical Field

The present disclosure relates to an inductor.

Background Art

Inductors used in electronic devices, particularly inductors for power supply, are required to have high performance (high inductance value) while being required to be reduced in size. As one of such inductors, there is an inductor having a coil embedded in a body, and an outer electrode connected to the coil and exposed from the body (see, for example, Japanese Unexamined Patent Application Publication No. 2007-165779).

In the inductor described in Japanese Unexamined Patent Application Publication No. 2007-165779, since an extended portion at each of both ends of the coil and an outer electrode are connected in the body, a region is required in which the extended portion and the outer electrode are connected in the body. In the inductor having such a region, a region occupied by the coil in the body is limited, and thus it is difficult to increase a size of the coil in order to obtain a high inductance value.

SUMMARY

Accordingly, the present disclosure provides an inductor capable of improving performance of the inductor (inductance value L) while having a certain region occupied by an extended portion of a coil.

An inductor according to an aspect of the present disclosure includes a body having a substantially rectangular parallelepiped shape and a pair of outer electrodes. The body includes a magnetic base, a coil, and a magnetic outer coating. The magnetic base includes a base portion and a columnar portion formed on an upper surface of the base portion. The coil includes a wound portion and a pair of extended portions. The wound portion is formed by winding a conductive wire having flat surface portions facing each other at upper and lower two stages around the columnar portion with one of the flat surface portions in contact with a side surface of the columnar portion. The wound portion has both ends that are located on an outer periphery and has an upper stage portion and a lower stage portion connected with each other by a conductive wire constituting an inner peripheral portion. The pair of extended portions are each drawn out from an outer peripheral portion of each stage of the wound portion toward a side surface of the base portion and each have a tip portion disposed on a lower surface of the base. The magnetic outer coating covers a part of the magnetic base, a part of the pair of extended portions, and the wound portion and contains magnetic powder. The pair of outer electrodes are disposed on a mounting surface of the body and connected to the pair of respective extended portions. A shape of the wound portion in plan view seen through from an upper surface of the body is a substantially annular shape having a short direction and a long direction, and the upper stage portion has a protruding portion protruding in the short direction.

Other features, elements, characteristics and advantages of the present disclosure will become more apparent from the following detailed description of preferred embodiments of the present disclosure with reference to the attached drawings.

DETAILED DESCRIPTION

Figure 1:
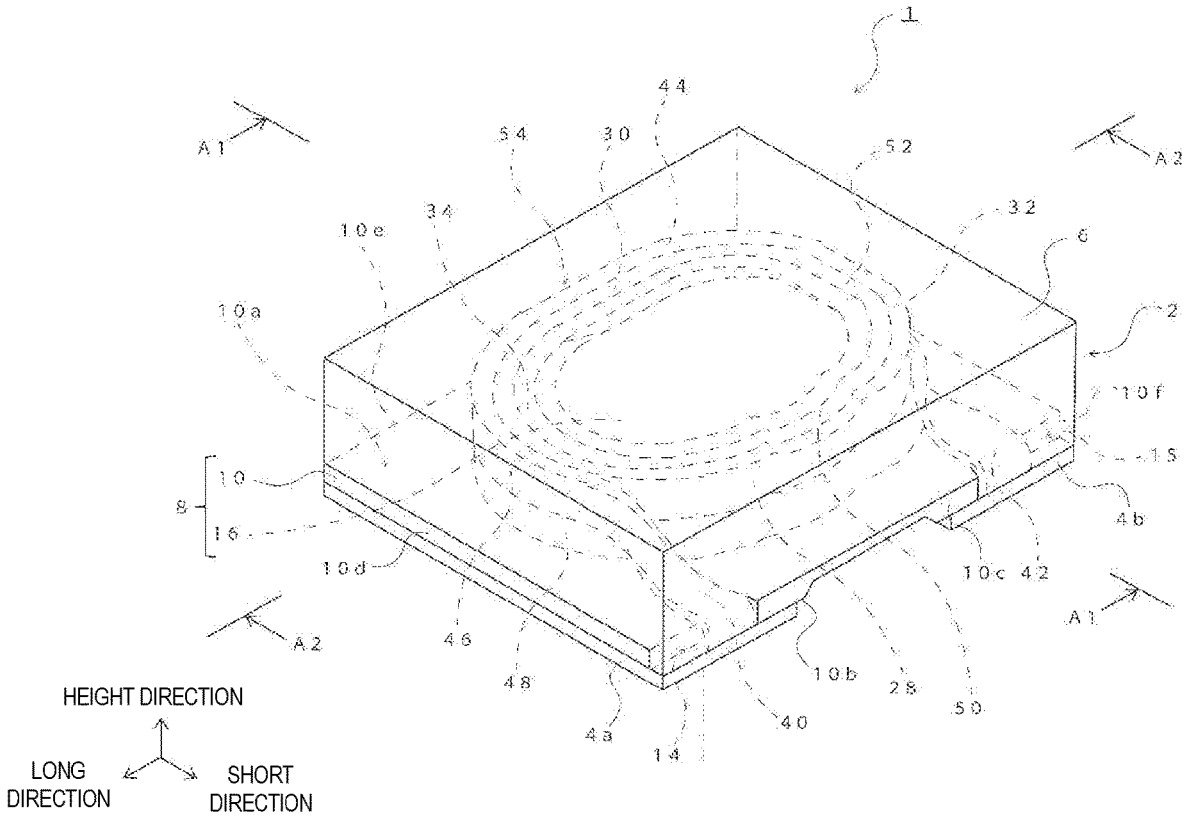
FIG. 1 is a perspective view from above illustrating an inductor according to a first embodiment of the present disclosure.

Hereinafter with reference to the drawings, embodiments and working examples for implementing the present disclosure will be described. Note that, an inductor described below is intended to embody the technical idea of the present disclosure, and the present disclosure is not limited to the following unless otherwise specified.

In the drawings, members having the same function are assigned the same reference numeral in some cases. In view of description of key points or ease of understanding, descriptions will be given separately for the embodiments and the working examples in some cases, but, partial substitutions or combinations of the configurations described in the different embodiments and working examples are possible. In the embodiments and working examples described below, descriptions common to aforementioned matters will be omitted, and only different points will be described. In particular, similar actions and effects according to similar configurations will not be referred to separately for each of the embodiments and the working examples. Sizes, positional relationships, and the like of members illustrated in each of the drawings may be exaggerated in some cases for clarity of description. Further, in the following description, a term indicating a specific direction or position is used as necessary (for example, "upper", "lower", "right", "left", and other terms including these terms). The use of these terms is to facilitate understanding of the disclosure with reference to the drawings, and the technical scope of the present disclosure is not limited by the meaning of these terms.

1. First Embodiment

Figure 2:
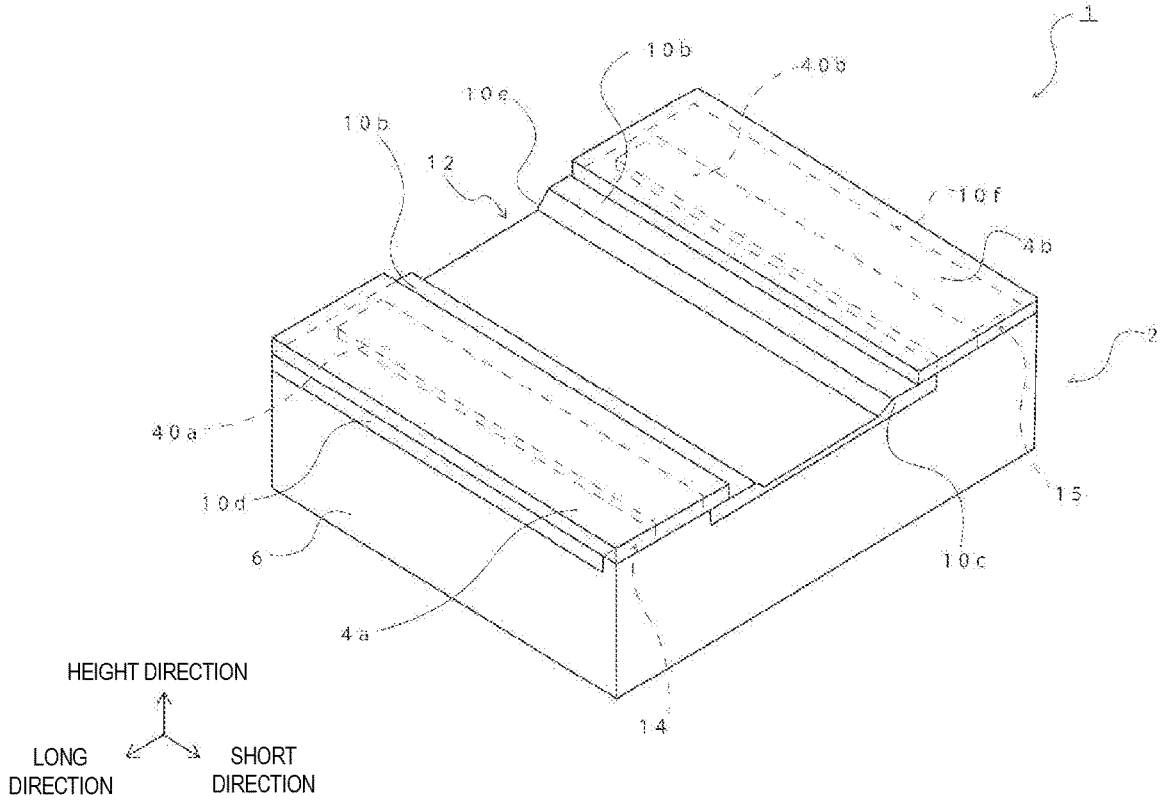
FIG. 2 is a perspective view from below illustrating the inductor according to the first embodiment of the present disclosure.
Figure 3:
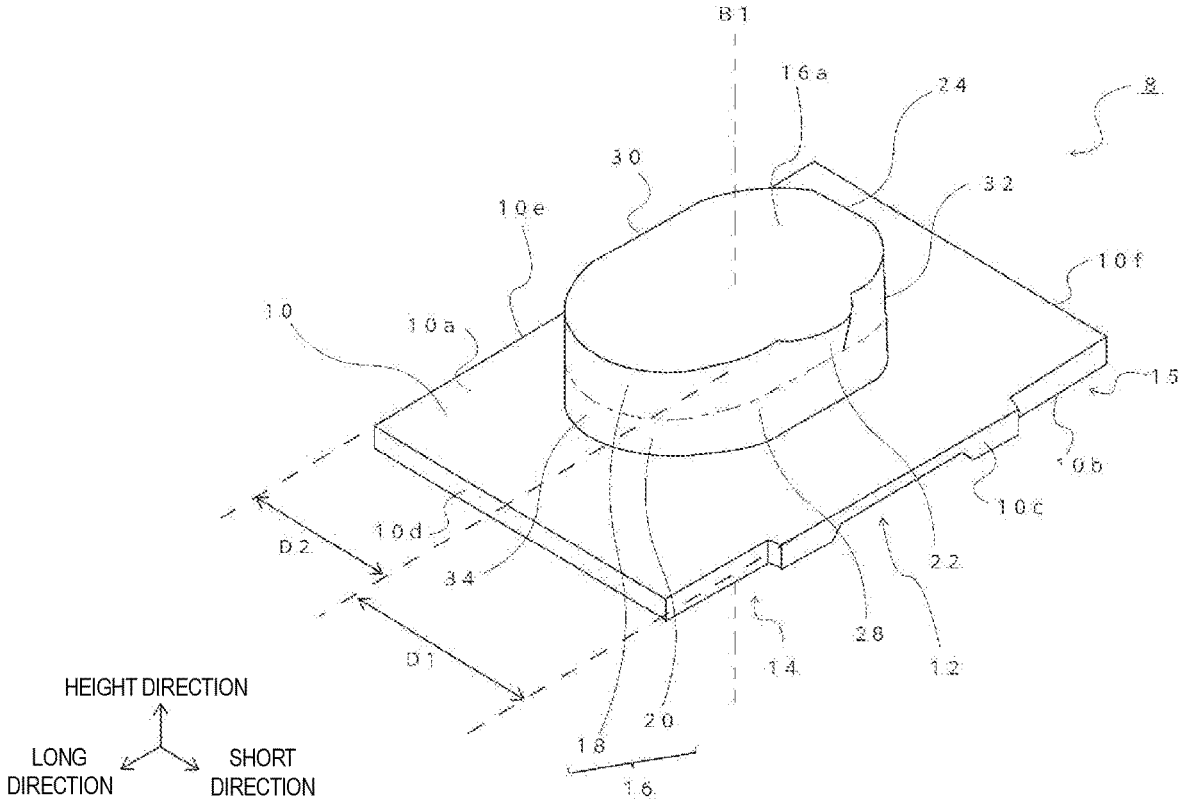
FIG. 3 is a perspective view illustrating only a magnetic base of the inductor in FIG. 1.
Figure 4:
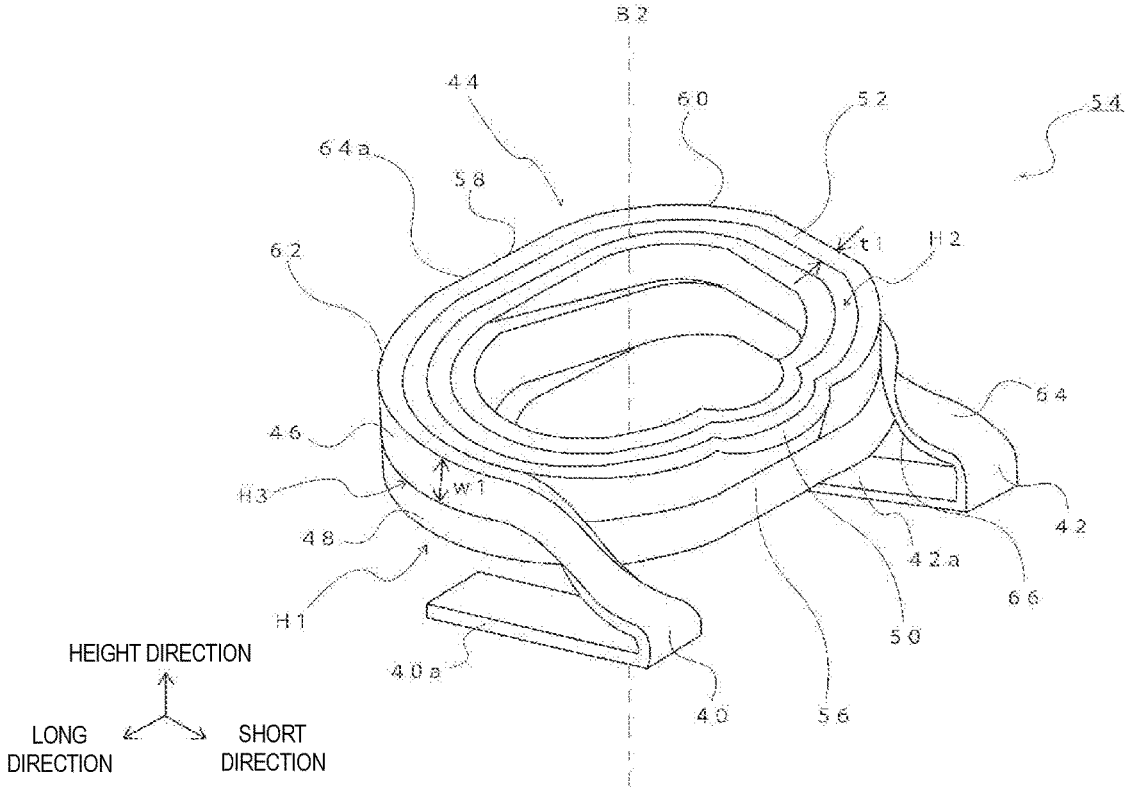
FIG. 4 is a perspective view illustrating only a coil of the inductor in FIG. 1.
Figure 5:
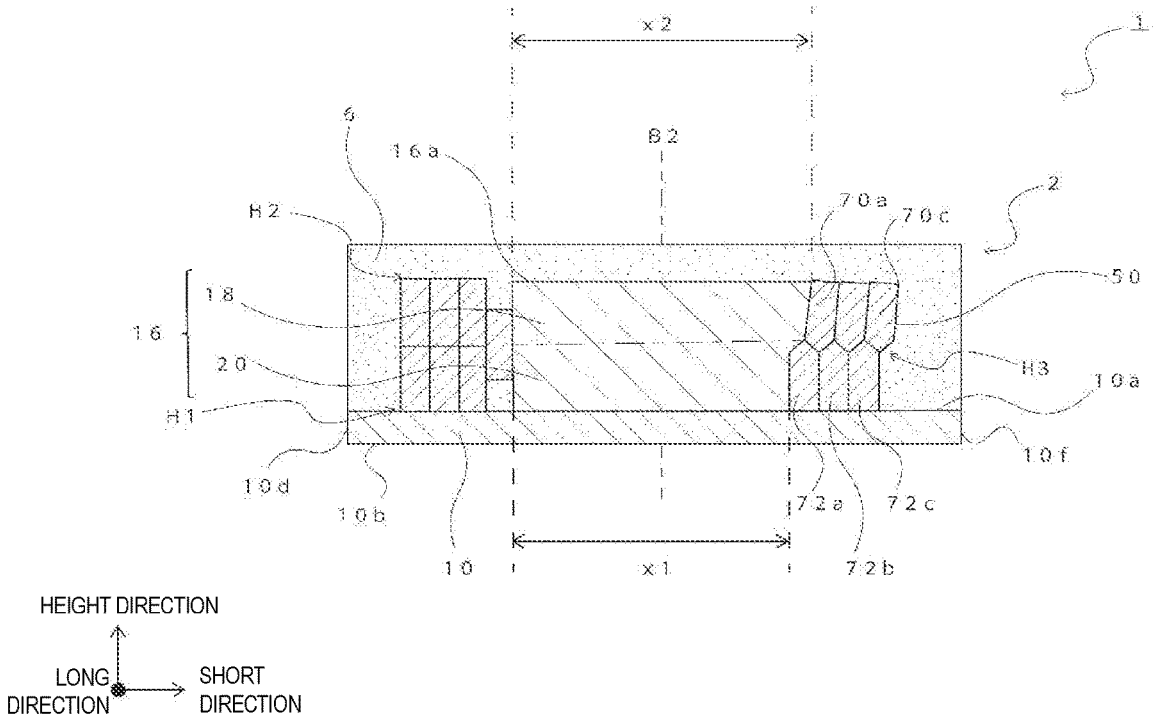
FIG. 5 is a sectional view taken along line A1-A1 in FIG. 1.
Figure 6:
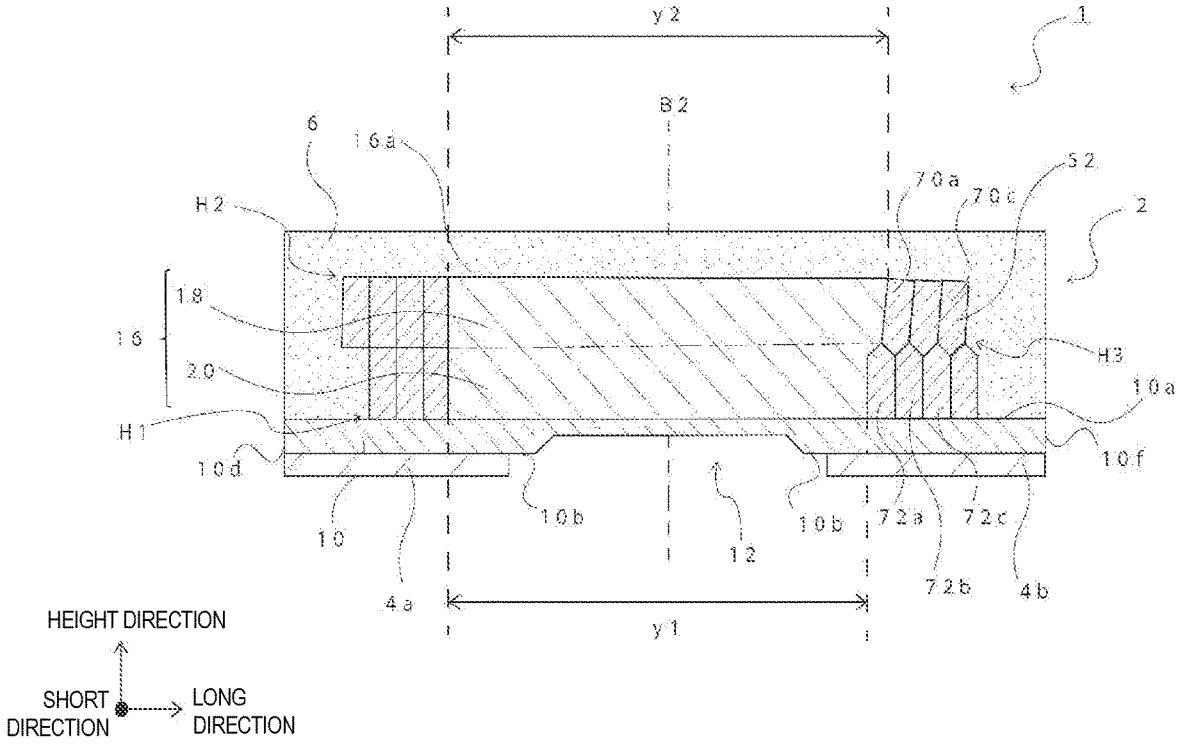
FIG. 6 is a sectional view taken along line A2-A2 in FIG. 1.
Figure 7:
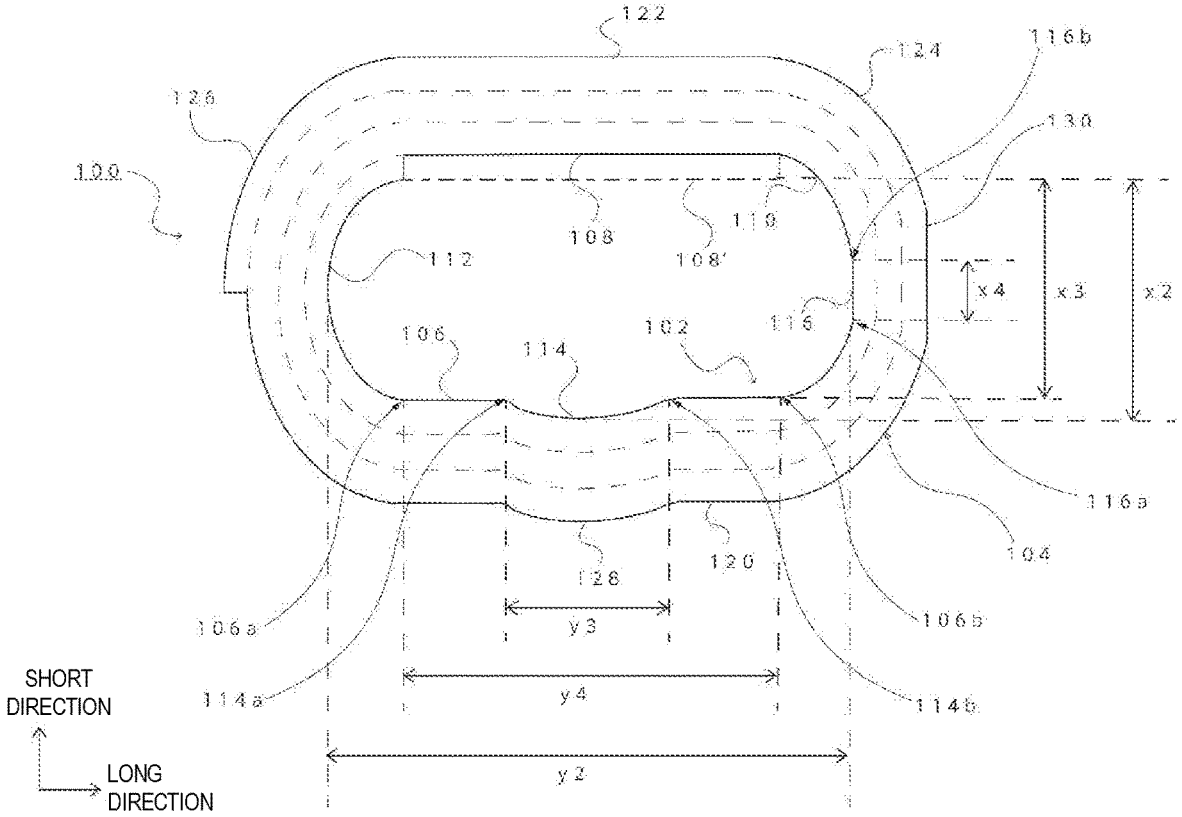
FIG. 7 is a diagram illustrating an outline of a wound portion on a surface including an opening end face of an upper stage portion of the inductor illustrated in FIG. 1.
Figure 8:
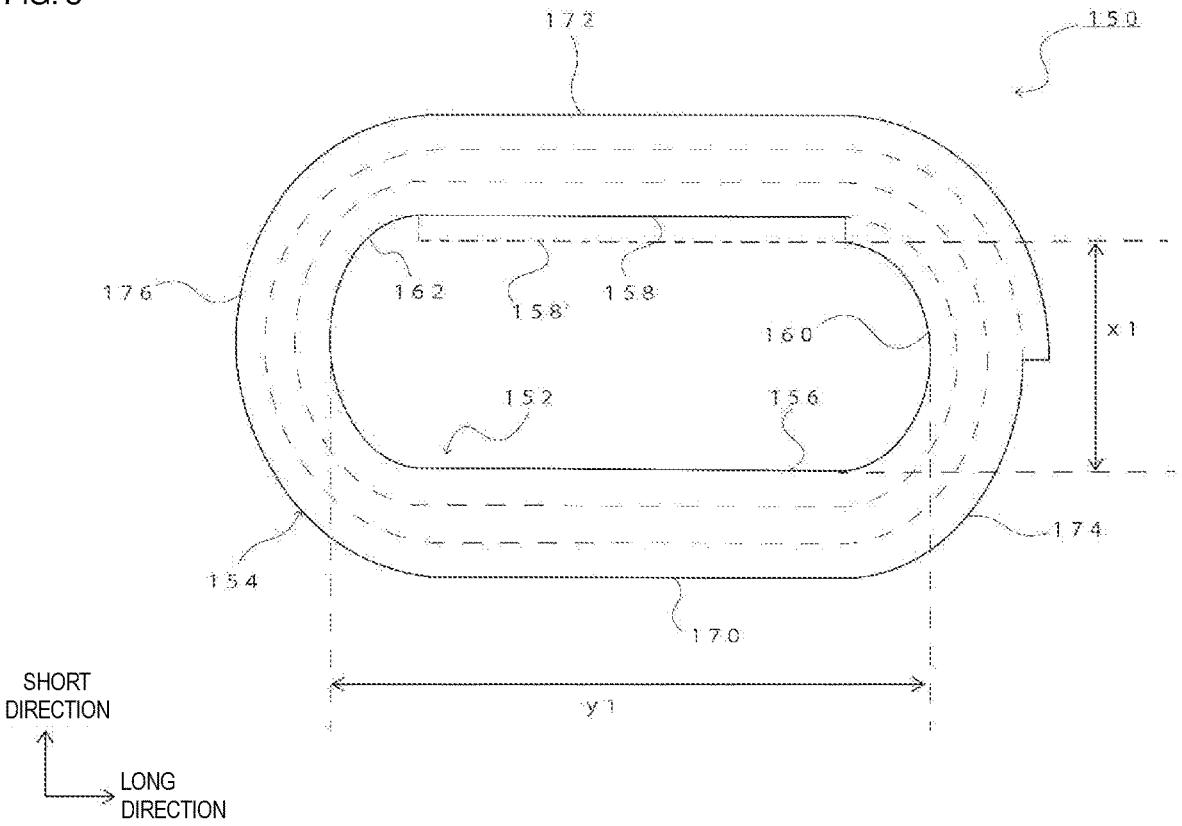
FIG. 8 is a diagram illustrating an outline of the wound portion on a surface including a boundary surface of a lower stage portion of the inductor illustrated in FIG. 1.
Figure 9:
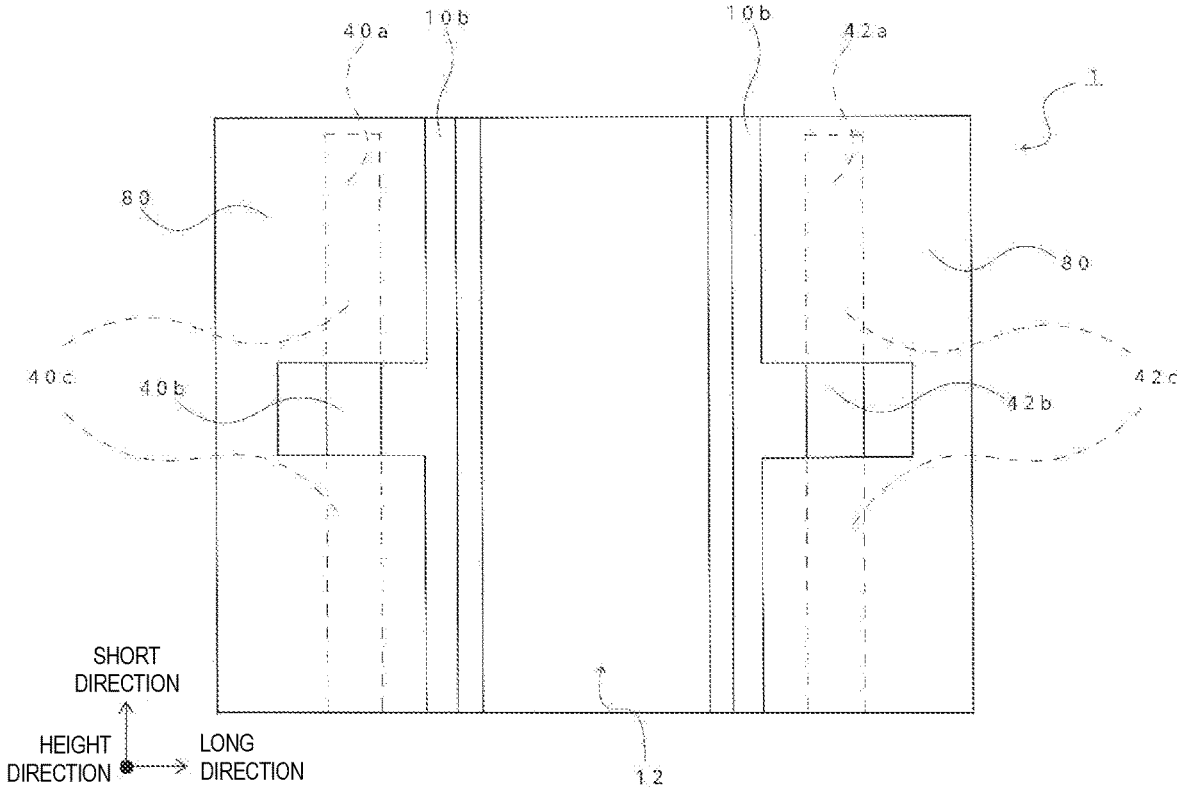
FIG. 9 is a diagram illustrating a conductive resin layer disposed in the inductor illustrated in FIG. 1.

Referring to FIG. 1 to FIG. 9, an inductor according to a first embodiment of the present disclosure will be described. FIG. 1 is a perspective view from above illustrating the inductor according to the first embodiment of the present disclosure. FIG. 2 is a perspective view from below illustrating the inductor according to the first embodiment of the present disclosure. FIG. 3 is a perspective view illustrating only a magnetic base of the inductor in FIG. 1. FIG. 4 is a perspective view illustrating only a coil of the inductor in FIG. 1. FIG. 5 is a sectional view taken along the line A1-A1 in FIG. 1. FIG. 6 is a sectional view taken along the line A2-A2 in FIG. 1. FIG. 7 is a diagram illustrating an outline of a wound portion on a surface including an opening end face of an upper stage portion of the inductor illustrated in FIG. 1. FIG. 8 is a diagram illustrating an outline of the wound portion on a surface including a boundary surface of a lower stage portion of the inductor illustrated in FIG. 1. FIG. 9 is a diagram illustrating a conductive resin layer disposed in the inductor illustrated in FIG. 1.

1. First Embodiment

As illustrated in FIG. 1 and FIG. 2, an inductor 1 includes a body 2, and a pair of outer electrodes 4*a* and 4*b* formed on a surface of the body 2. The body 2 includes a magnetic base 8, a coil 54, and a magnetic outer coating 6.

The magnetic base 8 has a base portion 10, and a columnar portion 16 formed on an upper surface 10*a* of the base portion 10.

The coil 54 has a wound portion 44 wound around the columnar portion 16, and a pair of extended portions 40 and 42 drawn out from an outer peripheral portion of the wound portion 44. The wound portion 44 is constituted by one conductive wire having flat surface portions facing each other, and having a substantially rectangular section and, is formed by winding the conductive wire at upper and lower two stages around the columnar portion 16, with one of the flat surface portions in contact with a side surface of the columnar portion 16, has both ends thereof located on an outer periphery, and has an upper stage portion 46 and a lower stage portion 48 connected to each other by a conductive wire constituting an inner peripheral portion. A shape in plan view seen through from an upper surface of the body 2 of the wound portion 44 is a substantially annular shape having a short direction and a long direction. The upper stage portion of the wound portion 44 has a protruding portion protruding in the short direction, and a straight portion 52 extending in the short direction and protruding in the long direction. The extended portions 40 and 42 forming the pair are each drawn out from the outer periphery of the wound portion 44 toward a side surface of the base portion 10, and tip portions 40*a* and 42*a* are disposed on a lower surface 10*b* of the base portion 10.

The magnetic outer coating 6 contains magnetic powder, and covers a part of the magnetic base 8, a part of the extended portions 40 and 42, and at least a part of the wound portion 44.

The outer electrode 4*a* of the pair is disposed so as to cover the tip portion 40*a* of the extended portion 40 of the pair, and the lower surface 10*b* around the tip portion 40*a*, and the outer electrode 4*b* of the pair is disposed so as to cover the tip portion 42*a* of the extended portion 42 of the pair, and the lower surface 10*b* around the tip portion 42*a*.

Hereinafter, each constituent member will be described in detail.

(1) Magnetic Base

The magnetic base 8 includes the base portion 10 and the columnar portion 16.

Base Portion

As illustrated in FIG. 3, the base portion 10 is a plate member having a substantially rectangular shape in which the upper surface 10*a* and the lower surface 10*b* each have a long direction and a short direction. The base portion 10 has a notch 14 at a corner portion formed by a first side surface 10*c* extending in the long direction and a second side surface 10*d* extending in the short direction, and has a notch 15 at a corner portion formed by the first side surface 10*c* and a fourth side surface 10*f* extending in the short direction. The notches 14 and 15 are intended for disposing the extended portions 40 and 42 of the coil 54, respectively. As illustrated in FIG. 2, a recessed portion 12 is provided in a center portion of the lower surface 10*b* of the base portion 10 along the short direction. As will be described later, the lower surface 10*b* of the base portion 10 is provided with the outer electrodes 4*a* and 4*b*, and serves as a mounting surface of the inductor 1. A length of the base portion 10 in the long direction is, for example, about 1.4 mm to about 2.2 mm, a length in the short direction is, for example, about 0.6 mm to about 1.4 mm, and a thickness (a length between the upper surface 10*a* and the lower surface 10*b*) is, for example, about 0.1 mm to about 0.2 mm Columnar Portion The columnar portion 16 is disposed on the upper surface 10*a* of the base portion 10.

A shape in a root portion on a side of the base portion 10 of a section substantially perpendicular to a winding axis B1 of the columnar portion 16 is a substantially elliptical shape having a short direction and a long direction. The winding axis B1 coincides with a center axis in the root portion on the side of the base portion 10 of the columnar portion 16. In addition, the short direction and the long direction of the columnar portion 16 substantially coincide with the short direction and the long direction of the base portion 10, respectively. The side surface of the columnar portion 16 has two planar regions 28 and 30 each extending in the long direction of the base portion 10, and two curved surface regions 32 and 34 connecting the two planar regions 28 and 30 with each other. A height of the columnar portion 16 is substantially two times that of a conductive wire forming the coil 54. When the columnar portion 16 is vertically bisected into an upper portion 18 and a lower portion 20, a first planar region 28 in the upper portion 18 has a protruding surface 22 protruding in the short direction. The protruding surface 22 is a curved surface. A degree of protrusion of the protruding surface 22 increases as a distance from the base portion 10 increases. Thus, the upper portion 18 of the columnar portion 16 thickens as a distance from the base portion 10 increases (see FIG. 5).

In addition, the first curved surface region 32 in the upper portion 18 of the columnar portion 16 has a flat surface 24 extending in the short direction. A degree of protrusion of the flat surface 24 increases as a distance from the base portion 10 increases. Thus, the upper portion 18 of the columnar portion 16 thickens as a distance from the base portion 10 increases (see FIG. 6).

Further, the columnar portion 16 is disposed on the upper surface 10*a* of the base portion 10 such that a length D1 between the winding axis B1 of the columnar portion 16 and the first side surface 10*c* of the base portion 10 is longer than a length D2 between the winding axis B1 of the columnar portion 16 and a third side surface 10*e* of the base portion 10.

Next, magnetic powder that is a material of the magnetic base 8 will be described. In the magnetic base 8, a filling rate of the magnetic powder is equal to or larger than about 60 wt %, preferably equal to or larger than about 80 wt %. As the magnetic powder, iron-based metal magnetic powder such as Fe, Fe—Si—Cr, Fe—Ni—Al, Fe—Cr—Al, Fe—Si, Fe—Si—Al, Fe—Ni, or Fe—Ni—Mo, metal magnetic powder of other composition, metal magnetic powder such as amorphous, metal magnetic powder in which surfaces are coated with an insulator such as glass, metal magnetic powder in which surfaces are modified, or nano-level minute metal magnetic powder is used. As resin, a thermosetting resin such as an epoxy resin, a polyimide resin, or a phenol resin, or a thermoplastic resin such as a polyethylene resin or a polyamide resin is used.

(2) Coil

As illustrated in FIG. 1 and FIG. 4, the coil 54 has the wound portion 44 wound around the columnar portion 16, and the pair of extended portions 40 and 42 drawn out from the outer peripheral portion of the wound portion 44.

A conductive wire used to form the coil 54 is a conductive wire having a covering layer with an insulating property on a surface of a conductor, having a fusion layer on a surface of the covering layer, having flat surface portions 64 and 66 facing each other, and having a substantially rectangular section (so-called rectangular wire). The conductor is formed of, for example, copper and the like, and has a width of about 140 μm to about 170 μm, and a thickness of about 67 μm to about 85 μm. The covering layer is formed of an insulating resin such as polyamide-imide, and has a thickness of, for example, about 1 μm to about 7 μm, and preferably about 6 μm. The fusion layer is formed of a thermoplastic resin, a thermosetting resin, or the like containing a self-fusing component so as to fix the conductive wires constituting the wound portion, and has a thickness of, for example, about 1 μm to about 3 μm, preferably about 1.5 μm. Thus, a length w1 in a line width direction of the conductive wire (width of each of the flat surface portions 64 and 66, line width) is, for example, about 144 μm to about 190 μm, and a thickness t1 (length between the flat surface portions 64 and 66 facing each other) is, for example, about 71 μm to about 105 μm.

Wound Portion

The wound portion 44 is formed by using one number of the conductive wire described above, and is wound around at upper and lower two stages such that both ends thereof are located on the outer periphery, and the upper stage portion 46 and the lower stage portion 48 are formed. The upper stage portion 46 and the lower stage portion 48 are connected to each other by the conductive wire forming the inner peripheral portion. The wound portion 44 is wound around the columnar portion 16 such that a winding axis B2 substantially coincides with the winding axis B1 of the columnar portion 16, and the flat surface portion of the conductive wire contacts the side surface of the columnar portion 16. The wound portion 44 is disposed such that an opening end face H1 of the lower stage portion 48 substantially coincides with the upper surface 10*a* of the base portion 10 of the magnetic base 8. Further, an opening end face H2 of the upper stage portion 46 substantially coincides with an upper surface 16*a* of the columnar portion 16. The opening end faces H1 and H2 are two end faces of the wound portion 44 that are substantially perpendicular to the winding axis B2. A shape in plan view of the wound portion 44 is a substantially elliptical annular shape having a short direction and a long direction. The wound portion 44 has a first planar region 56, a second planar region 58, a first curved region 60 and a second curved region 62 connecting the two planar regions 56 and 58 to each other. The first planar region 56 is a region along the first planar region 28 of the columnar portion 16 of the magnetic base 8, and the second planar region 58 is a region along the second planar region 30 of the columnar portion 16. The first curved region 60 is a region along the first curved surface region 32 of the columnar portion 16, and the second curved region 62 is a region along the second curved surface region 34 of the columnar portion 16. The first planar region 56 of the upper stage portion 46 includes a protruding portion 50 protruding in a short direction, along the protruding surface 22 of the columnar portion 16. In addition, the first curved region 60 of the upper stage portion 46 includes the straight portion 52 extending in a short direction, along the flat surface 24 of the columnar portion 16.

Protruding Portion

The protruding portion 50 is a region in which the conductive wire protrudes in the short direction while curving. A line width direction of the conductive wire of the protruding portion 50 inclines with respect to the winding axis B2. The line width direction of the conductive wire of the protruding portion 50 inclines so as to be separated from the winding axis B2 as a distance from the lower stage portion 48 increases (see FIG. 5). Thus, the protruding portion 50 protrudes in the short direction between a boundary surface H3 of the upper stage portion 46 and the lower stage portion 48 and the opening end face H2 of the upper stage portion 46, and a degree of protrusion thereof is maximized at the opening end face H2.

Referring to FIG. 7 and FIG. 8, a maximum dimension of the protruding portion 50 on the opening end face H2 at which the degree of protrusion is maximized will be described. First, an outline 100 of the wound portion 44 illustrated in FIG. 7 and FIG. 8 will be described.

As illustrated in FIG. 7, the outline 100 of the wound portion 44 on the opening end face H2 of the upper stage portion 46 includes an inner peripheral outline 102 of the wound portion 44, and an outer peripheral outline 104 of the wound portion 44.

The inner peripheral outline 102 is constituted by an inner peripheral outline 106 of the first planar region 56, an inner peripheral outline 108 of the second planar region 58, an inner peripheral outline 110 of the first curved region 60, and an inner peripheral outline 112 of the second curved region 62. Further, the inner peripheral outline 106 of the first planar region 56 includes an inner peripheral outline 114 of the protruding portion 50, and the inner peripheral outline 110 of the first curved region 60 includes an inner peripheral outline 116 of the straight portion 52. Further, the inner peripheral outline 108 of the second planar region 58 includes an inner peripheral outline 108' formed by a conductive wire located inside the inner peripheral outline 108 and extending from the opening end face H2 of the upper stage portion 46 toward the boundary surface H3 of the lower stage portion 48, as indicated by an alternate long and short dash line.

The outer peripheral outline 104 is constituted by an outer peripheral outline 120 of the first planar region 56, an outer peripheral outline 122 of the second planar region 58, an outer peripheral outline 124 of the first curved region 60, and an outer peripheral outline 126 of the second curved region 62. Further, the outer peripheral outline 120 of the first planar region 56 includes an outer peripheral outline 128 of the protruding portion 50, and the outer peripheral outline 124 of the first curved region 60 includes an outer peripheral outline 130 of the straight portion 52.

As illustrated in FIG. 8, an outline 150 of the wound portion 44 on the boundary surface H3 of the lower stage portion 48 of the wound portion 44 includes an inner peripheral outline 152 of the wound portion 44, and an outer peripheral outline 154 of the wound portion 44.

The inner peripheral outline 152 is constituted by an inner peripheral outline 156 of the first planar region 56, an inner peripheral outline 158 of the second planar region 58, an inner peripheral outline 160 of the first curved region 60, and an inner peripheral outline 162 of the second curved region 62. Furthermore, the inner peripheral outline 158 of the second planar region 58 includes an inner peripheral outline 158' formed by a conductive wire located inside the inner peripheral outline 158 and extending from the boundary surface H3 of the lower stage portion 48 toward the opening end face H2 of the upper stage portion 46, as indicated by an alternate long and short dash line.

The outer peripheral outline 154 is constituted by an outer peripheral outline 170 of the first planar region 56, an outer peripheral outline 172 of the second planar region 58, an outer peripheral outline 174 of the first curved region 60, and an outer peripheral outline 176 of the second curved region 62.

A length y3 in a long direction between two end portions 114*a* and 114*b* in the inner peripheral outline 114 of the protruding portion 50 is about ¼ to about ¾ of a length y4 between two end portions 106*a* and 106*b* in the inner peripheral outline 106 of the first planar region 56 (see FIG. 7).

A maximum length x2 in a short direction between the inner peripheral outline 108' located inside the inner peripheral outline 108 of the second planar region 58 and formed by a conductive wire extending from the opening end face H2 of the upper stage portion 46 toward the boundary surface H3 of the lower stage portion 48 and the inner peripheral outline 114 of the protruding portion 50 is longer than a length x1 between the inner peripheral outline 156 of the first planar region 56 of the lower stage portion 48 and the inner peripheral outline 158' located inside the inner peripheral outline 158 of the second planar region 58 and formed by a conductive wire extending from the boundary surface H3 of the lower stage portion 48 toward the opening end face H2 of the upper stage portion 46, by about ⅙ to about ⅓ of the length x1 (see FIG. 7 and FIG. 8). The length x2 corresponds to a width of the inner peripheral outline 102 in a short direction.

Next, a disposition relationship between a conductive wire in the protruding portion 50 and a conductive wire of the lower stage portion 48 located below the protruding portion 50 will be described. As illustrated in FIG. 5, conductive wires of respective circumferences of the protruding portion 50 are not disposed immediately above conductive wires of respective circumferences of the lower stage portion 48. Specifically, a first conductive wire 70*a* in a first circumference from an inside of the protruding portion 50 is disposed above a first conductive wire 72*a* in a first circumference and a second conductive wire 72*b* in a second circumference of the lower stage portion 48. That is, the first conductive wire 70*a* of the protruding portion 50 is supported by the first conductive wire 72*a* and the second conductive wire 72*b* of the lower stage portion 48. Similarly, the conductive wires of the second and subsequent circumferences of the protruding portion 50 are also each supported by two conductive wires of continuous circumferences of the lower stage portion 48. However, an outermost conductive wire 70*c* of the protruding portion 50 is supported only by an outermost conductive wire 72*c* of the lower stage portion 48. Further, a section of the boundary surface H3 between the conductive wire of the protruding portion 50 and the conductive wire of the lower stage portion 48 located below the protruding portion 50 has a substantially wavy shape.

Straight Portion

As illustrated in FIG. 6, a line width direction of a conductive wire of the straight portion 52 inclines with respect to the winding axis B2. The line width direction of the conductive wire of the straight portion 52 inclines so as to be separated from the winding axis B2 as a distance from the lower stage portion 48 increases. Thus, the straight portion 52 protrudes in a long direction between the boundary surface H3 of the upper stage portion 46 and the lower stage portion 48 and the opening end face H2 of the upper stage portion 46, and a degree of protrusion thereof is maximized at the opening end face H2.

Referring to FIG. 7, a length of the straight portion 52 in a short direction will be described. A length x4 of the inner peripheral outline 116 of the straight portion 52 (length between two end portions 116*a* and 116*b*) is about ¼ to about ¾ of a length x3 between the inner peripheral outline 106 of the first planar region 56, and the inner peripheral outline 108' located inside the inner peripheral outline 108 of the second planar region 58 and formed by a conductive wire extending from the opening end face H2 of the upper stage portion 46 toward the boundary surface H3 of the lower stage portion 48. Further, referring to FIG. 8 in addition to FIG. 7, the degree of protrusion of the straight portion 52 will be described. A maximum length y2 in the long direction between the inner peripheral outline 116 of the straight portion 52 and the inner peripheral outline 112 of the second curved region 62 is longer than a maximum length y1 in the long direction between the inner peripheral outline 160 of the first curved region 60 and the inner peripheral outline 162 of the second curved region 62 of the lower stage portion 48, by about ⅛ to about ⅙ of the length y1. The length y2 corresponds to a width of the inner peripheral outline 102 in the long direction.

In addition, similarly to the conductive wires of the protruding portion 50, the conductive wire of each circumference of the straight portion 52 is supported by conductive wires of two adjacent circumferences of the lower stage portion 48 located below the straight portion 52, except for the outermost conductive wire 70*c*. Further, a section of the boundary surface H3 between the conductive wire of the straight portion 52 and the conductive wire of each the circumference of the lower stage portion located below the straight region also has a substantially wavy shape.

Extended Portion

Next, the extended portions 40 and 42 will be described with reference to FIG. 1 and FIG. 4.

The extended portion 40 of the pair is continuous to an outermost conductive wire of each the stage portion 46 of the wound portion 44, and the extended portion 42 of the pair is continuous to an outermost conductive wire of each the stage portion 48 of the wound portion 44. The extended portions 40 and 42 forming the pair are drawn out from a side of the upper surface 10*a* toward a side of the lower surface 10*b*, via the respective notches 14 and 15 of the base portion 10 of the magnetic base 8. Each of the extended portions 40 and 42 forming the pair is twisted by about 90 degrees on the side of the upper surface 10*a* of the base portion 10 such that the flat surface portions 64 and 66 are substantially parallel to the upper surface 10*a* of the base portion 10. The tip portions 40*a* and 42*a* of the respective extended portions 40 and 42 drawn out toward the side of the lower surface 10*b* are disposed such that the flat surface portion 66 on one side contacts the lower surface 10*b*. Additionally, each of a line width of the conductive wire of a portion of the extended portion 40 of the pair that is in front of a portion close to the notch 14, and a line width of the conductive wire of a portion of the extended portion 42 of the pair that is in front of a portion close to the notch 15, is larger than a line width of the conductive wire of the wound portion 44, and each of a thickness of the conductive wire of the extended portion 40 of the pair that is in front of a portion close to the notch 14, and a thickness of the conductive wire of the extended portion 42 of the pair that is in front of a portion close to the notch 15, is smaller than a thickness of the conductive wire of the wound portion 44.

(3) Magnetic Outer Coating

The magnetic outer coating 6 covers the upper surface 10*a* of the base portion 10 of the magnetic base 8 and respective inner surfaces of the notches 14 and 15, the columnar portion 16 of the magnetic base 8, the wound portion 44 of the coil 54, a region of the extended portion 40 of the coil 54 excluding the tip portion 40*a*, and a region of the extended portion 42 of the coil 54 excluding the tip portion 42*a*. However, an outer flat surface portion 64*a* of an outermost conductive wire in the second planar region 58 of the wound portion 44 may be exposed from the magnetic outer coating 6. In this case, it is desirable that the outer flat surface portion 64*a* of the conductive wire is disposed substantially flush with the third side surface 10*e* of the base portion 10 of the magnetic base 8. This can be realized by appropriately setting the length D1 between the winding axis B1 of the columnar portion 16 and the first side surface 10*c* of the base portion 10, and a thickness t1 of the conductive wire forming the coil 54, and the number of turns N.

The magnetic outer coating 6 contains magnetic powder similar to the magnetic powder contained in the magnetic base 8, but composition, an average particle diameter, a filling rate, and the like may be different. The filling rate of the magnetic powder is equal to or larger than about 60 wt %, and preferably equal to or larger than about 80 wt %. As the magnetic powder, iron-based metal magnetic powder such as Fe, Fe—Si—Cr, Fe—Ni—Al, Fe—Cr—Al, Fe—Si, Fe—Si—Al, Fe—Ni, or Fe—Ni—Mo, metal magnetic powder of other composition, metal magnetic powder such as amorphous, metal magnetic powder in which surfaces are coated with an insulator such as glass, metal magnetic powder in which surfaces are modified, or nano-level minute metal magnetic powder is used. As resin, a thermosetting resin such as an epoxy resin, a polyimide resin, or a phenol resin, or a thermoplastic resin such as a polyethylene resin or a polyamide resin is used.

Note that, the magnetic powder of the magnetic base 8 and the magnetic powder of the magnetic outer coating 6 may be the same in composition, an average particle diameter, density, and the like, or may be different from each other. In addition, each of the magnetic powder of the magnetic base 8 and the magnetic powder of the magnetic outer coating 6 may be configured by mixing first magnetic powder and second magnetic powder having different average particle diameters from each other.

Then, the body 2 is formed by the magnetic base 8, the coil 54, and the magnetic outer coating 6. The body 2 is formed in a substantially rectangular parallelepiped shape, that includes an upper surface and a lower surface each having a substantially rectangular shape and a long direction and a short direction, and four side surfaces adjacent to the upper surface and the lower surface.

(4) Outer Electrode

As illustrated in FIG. 2, the outer electrodes 4*a* and 4*b* forming the pair are disposed so as to be spaced apart from each other on the mounting surface of the body 2 (that is, the lower surface 10*b* of the base portion 10 of the magnetic base 8). The outer electrode 4*a* of the pair is disposed so as to cover the tip portion 40*a* of the extended portion 40, and the lower surface 10*b* near the tip portion 40*a*, and the outer electrode 4*b* of the pair is disposed so as to cover the tip portion 42*a* of the extended portion 42, and the lower surface 10*b* near the tip portion 42*a*. The outer electrode 4*a* of the pair includes a conductive resin layer 80 containing silver powder, a nickel layer, and a tin layer, in an order of disposition on a side of the tip portion 40*a* and the lower surface 10*b*, and the outer electrode 4*b* of the pair includes the conductive resin layer 80 containing the silver powder, the nickel layer, and the tin layer, in an order of disposition on a side of the tip portion 42*a* and the lower surface 10*b*. A thickness of the conductive resin layer 80 is about 6 μm to about 13 μm, a thickness of the nickel layer is about 3 μm to about 6 μm, a thickness of the tin layer is about 1 μm, and a thickness of each of the outer electrodes 4*a* and 4*b* is about 10 μm to about 20 μm.

An exterior resin (not illustrated) is formed on the surface of the body 2 other than respective regions in which the outer electrodes 4*a* and 4*b* forming the pair are disposed. Examples of the exterior resin include thermosetting resins such as an epoxy resin, a polyimide resin, and a phenol resin, or thermoplastic resins such as a polyethylene resin and a polyamide resin, and may further include a filler including silicon, titanium, and the like.

Note that, as illustrated in FIG. 9, the conductive resin layer 80 may be formed to have a shape in which, a notch that exposes a central region 40*b* of the tip portion 40*a* interposed between both end regions 40*c* is included, on the lower surface 10*b* and both the end regions 40*c* of the tip portion 40*a*, and a notch that exposes a central region 42*b* of the tip portion 42*a* interposed between both end regions 42*c* is included, on the lower surface 10*b* and both the end regions 42*c* of the tip portion 42*a*. In this case, the nickel layer is disposed on the conductive resin layer 80, and on the central regions 40*b* and 42*b* of the respective tip portions 40*a* and 42*a*. The tin layer is disposed on the nickel layer. The notches are disposed so as to face each other.

In the inductor formed as described above, for the body 2 including the exterior resin, a length in the long direction is, for example, about 1.4 mm to about 2.2 mm, a length in the short direction is, for example, about 0.6 mm to about 1.4 mm, and a height is, for example, about 0.6 mm to about 1 mm.

Figure 10:
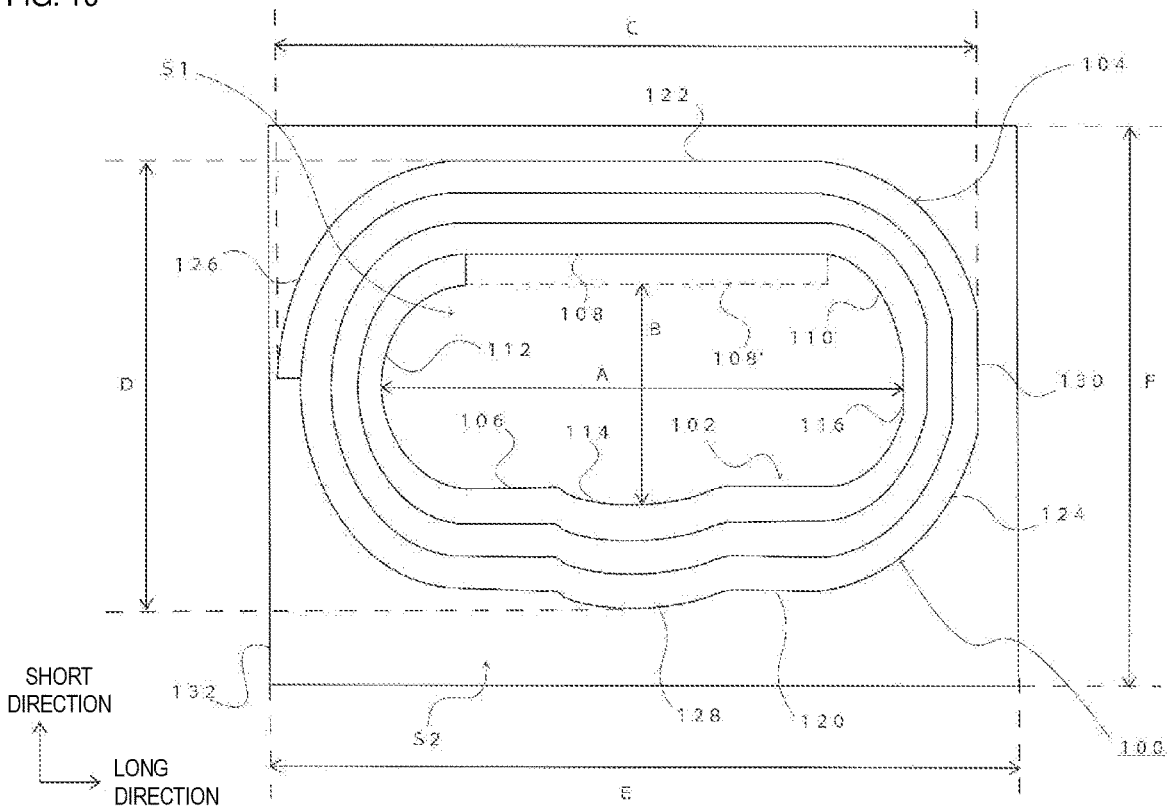
FIG. 10 is a diagram illustrating dimensions of a wound portion and dimensions of a body on a surface including an opening end face of an upper stage portion of an inductor according to a working example.
Figure 11:
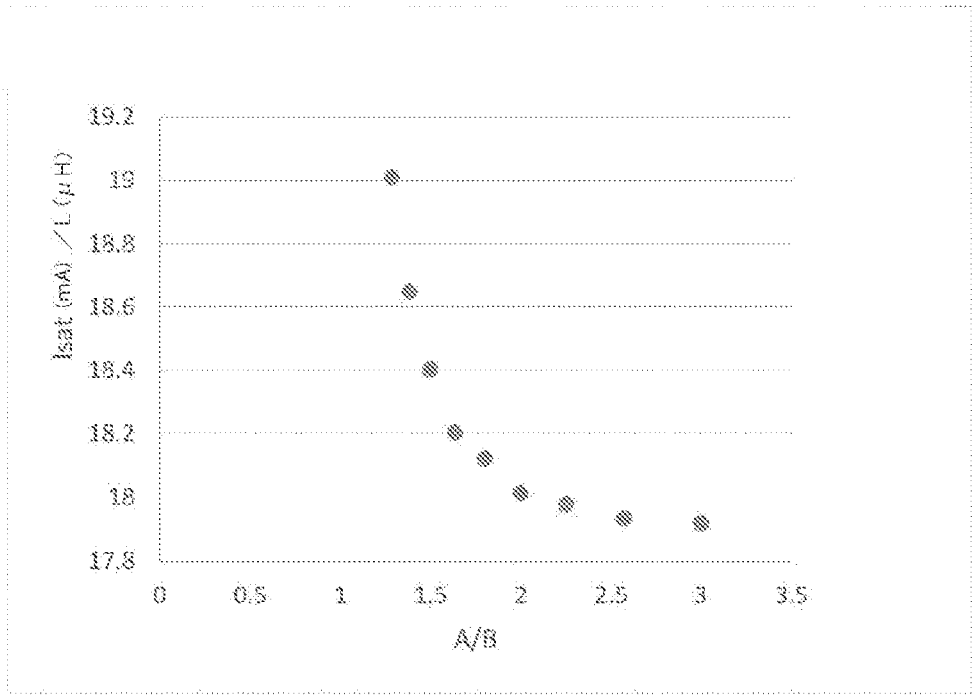
FIG. 11 is a graph showing a relationship between ratio A/B and a ratio of rated current to an inductance value in a first working example.
Figure 12:
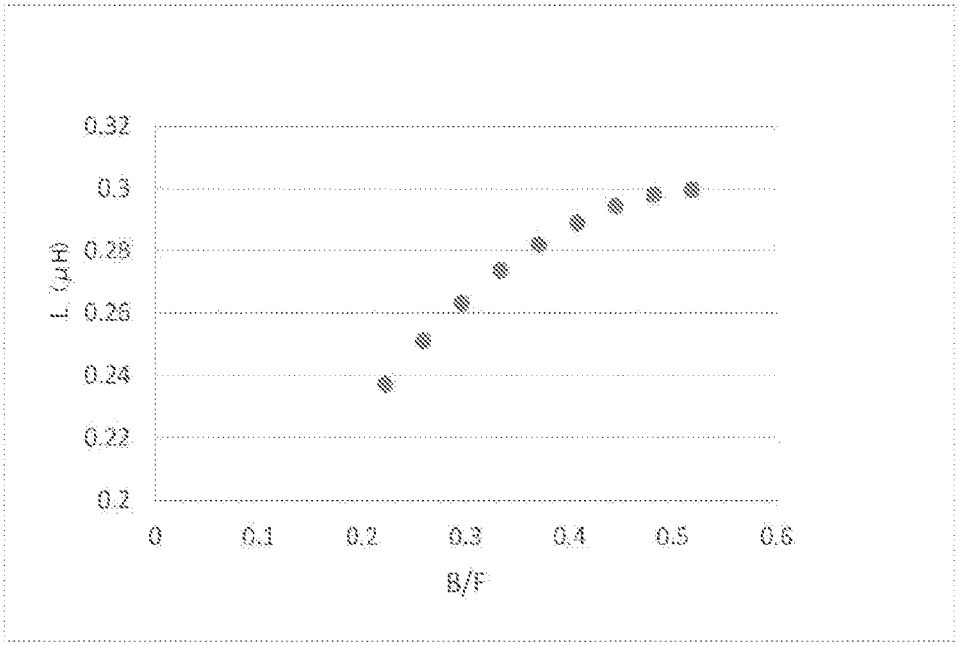
FIG. 12 is a graph showing a relationship between ratio B/F and an inductance value in a second working example.

In the inductor configured as described above, a degree of protrusion of the protruding portion 50 and/or the straight portion 52 of the wound portion 44 was changed to perform simulation based on a rated current Isat (mA) and/or an inductance value L (μH) of the inductor 1. Hereinafter, a first working example to a third working example will be described with reference to FIG. 10 to FIG. 12. FIG. 10 is a diagram illustrating dimensions of a wound portion on a surface including an opening end face of an upper stage portion and dimensions of a body of an inductor according to a working example. FIG. 11 is a graph showing a relationship between ratio A/B and a ratio of rated current to an inductance value in the first working example. FIG. 12 is a graph showing a relationship between ratio B/F and an inductance value in the second working example.

2. First Working Example

In the present working example, in an inductor configured as in the first embodiment, the rated current Isat (mA) and the inductance value L obtained by changing the degree of protrusion of each of the protruding portion 50 and the straight portion 52 were simulated. Specifically, in the body 2, by changing a ratio A/B of a maximum length y2 (expressed as a first length A in the working example) in a long direction between the inner peripheral outline 116 of the straight portion 52 and the inner peripheral outline 110 of the second curved region 62, to a maximum length x2 (expressed as a second length B in the working example) in a short direction between the inner peripheral outline 108' located inside the inner peripheral outline 108 of the second planar region 58, on a side of the opening end face H2 of the upper stage portion 46 of the wound portion 44 of the coil 54, and formed by a conductive wire extending from the opening end face H2 of the upper stage portion 46 toward the boundary surface H3 of the lower stage portion 48 and the inner peripheral outline 114 of the protruding portion 50, the rated current Isat (mA) and the inductance value L to be obtained were simulated, and comparison was performed using this ratio. FIG. 11 shows a relationship between the ratio A/B and the ratio of the rated current to the inductance value. A horizontal axis indicates the ratio A/B, and a vertical axis indicates the ratio of the rated current Isat (mA) to the inductance value L.

In the present working example, in a state in which a length E in the long direction of the body 2 and a length F in the short direction of the body 2 are constant, the first length A and the second length B were changed within a range thereof, the rated current Isat (mA) and the inductance value L were simulated, and the ratio A/B was changed from equal to or larger than about 1 to equal to or less than about 3 (i.e., from about 1 to about 3), and the ratio of the rated current Isat (mA) to the inductance value L was compared. Note that, the simulation was performed with the length E in the long direction of the body 2 set to about 2.06 mm, and the length F in the short direction of the body 2 set to about 1.35 mm. Further, the number of turns N of an entirety of the coil was set to 5. Note that, a maximum length (third length) C in the long direction between the outer peripheral outline 124 of the first curved region 60 and the outer peripheral outline 126 of the second curved region 62 is smaller than the length E in the long direction of the body 2. A maximum length (fourth length) D in the short direction between the outer peripheral outline 120 of the first planar region 56 and the outer peripheral outline 122 of the second planar region 58 is smaller than the length F in the short direction of the body 2. The third length C corresponds to a width in a long direction of the outer peripheral outline 104 of the wound portion 44, and the fourth length D corresponds to a width in a short direction of the outer peripheral outline 104 of the wound portion 44.

As illustrated in FIG. 11, when the ratio A/B was about 1.3, the ratio of the rated current Isat (mA) to the inductance value L was about 19.01, but the ratio of the rated current Isat (mA) to the inductance value L decreased from about 18.4, about 18.12, about 18.01, about 17.97, to about 17.93 when the ratio A/B was increased from about 1.5, about 1.8, about 2, about 2.25, to about 2.6, and the ratio of the rated current Isat (mA) to the inductance value L was about 17.91 when the ratio A/B was about 3. Accordingly, when the ratio A/B was equal to or larger than about 1.7 and equal to or less than about 3 (i.e., from about 1.7 to about 3), preferably equal to or larger than about 2 and equal to or less than about 3 (i.e., from about 2 to about 3), more preferably equal to or larger than about 2.3 and equal to or less than about 2.6 (i.e., from about 2.3 to about 2.6), the ratio of the rated current Isat (mA) to the inductance value L became smaller compared to when the ratio A/B was about 1.3, and variation in the rated current obtained by the inductance value became smaller compared to when the ratio A/B was about 1.3, and a probability could be improved that a predetermined rated current is obtained even when the inductance value varies somewhat.

3. Second Working Example

In the present working example, in an inductor configured as in the first embodiment, the inductance value L (μH) was simulated by changing the degree of protrusion of the protruding portion 50. Specifically, the inductance value L (μH) was measured by changing the ratio B/F of the second length B to the length F in the short direction of the body 2. FIG. 12 shows a relationship between the ratio B/F and the inductance value L (μH). A horizontal axis indicates the ratio B/F, and a vertical axis indicates the inductance value L (μH).

In the present working example, in a state in which the length E in the long direction of the body 2 and the length F in the short direction of the body 2 are constant, the inductance value obtained by changing the ratio B/F, within a range thereof, from about 0.22 to about 0.52 was simulated. In the present working example, the simulation was performed with the length E in the long direction of the body 2 set to about 2.06 mm, and the length F in the short direction of the body 2 set to about 1.35 mm.

As shown in FIG. 12, when the ratio B/F was about 0.22, the inductance value L was about 0.22, but the inductance value L increased from about 0.22, about 0.26, about 0.28, about 0.29, to about 0.29, when the ratio B/F increased from about 0.3, about 0.4, about 0.48, to about 0.52. Note that, the inductance value was not further increased even when the ratio B/F became greater than about 0.52, and thus, illustration is omitted in FIG. 12. Further, when the ratio B/F exceeds about 0.6, a probability that the outer periphery of the wound portion of the coil is exposed from the body increases. Accordingly, when the ratio B/F was equal to or larger than about 0.3 and equal to or less than about 0.6 (i.e., from about 0.3 to about 0.6), the inductance value L was equal to or larger than about 0.26 μH, and a higher inductance value could be obtained. In particular, when the ratio B/F was equal to or larger than about 0.5, the inductance value L was equal to or larger than about 0.3 μH, and, a further higher inductance value could be obtained. This makes it possible to improve the rated current.

4. Third Working Example

In the present working example, in an inductor configured as in the first embodiment, the inductance value L (μH) was simulated by changing the degree of protrusion of the straight portion 52. Specifically, the inductance value L (μH) was simulated by changing a ratio A/E of the first length A to the length E in the long direction of the body 2.

In the present working example, in a state in which the length E in the long direction of the body 2 and the length F in the short direction of the body 2 are constant, the inductance value obtained by changing the ratio A/E, within a range thereof, from about 0.4 to about 0.7 was simulated.

When the ratio A/E was about 0.43, the inductance value L was about 0.23, but the inductance value L tended to increase from about 0.26, about 0.29, to about 0.3, when the ratio A/E increased from about 0.56, about 0.6, to about 0.63. In particular, when the ratio A/E was equal to or larger than about 0.6, the inductance value L was equal to or larger than about 0.29 μH, and a higher inductance value could be obtained. This makes it possible to improve the rated current. However, when the ratio A/E is equal to or larger than about 0.9, the pair of extended portions are highly likely to be exposed from the body, and thus, the ratio A/E is preferably equal to or larger than about 0.6 and equal to or less than about 0.9 (i.e., from about 0.6 to about 0.9).

From the results of the first to third working examples described above, it has been found that the protruding portion 50 and the straight portion 52 according to the inductor 1 of the present embodiment are desirably formed so as to satisfy any one of the following conditions.

Condition 1

In a plane including the opening end face H2 of the upper stage portion 46, the ratio A/B of the width (the first length) A in the long direction of the inner peripheral outline 102 of the wound portion 44, to the width (the second length) B in the short direction of the inner peripheral outline 102 is equal to or larger than about 1.7 and equal to or less than about 3 (i.e., from about 1.7 to about 3).

Condition 2

In the plane including the opening end face H2 of the upper stage portion 46, the ratio of the width (the second length) B in the short direction of the inner peripheral outline 102 of the wound portion 44, to the length F in the short direction of the body 2 is equal to or larger than about 0.3 and equal to or less than about 0.6 (i.e., from about 0.3 to about 0.6).

Condition 3

In the plane including the opening end face H2 of the upper stage portion 46, the ratio of the width (the first length) A in the long direction of the inner peripheral outline 102, to the length E in the long direction of the body 2 is equal to or larger than about 0.6 and equal to or less than about 0.9 (i.e., from about 0.6 to about 0.9).

Further, as for inductors, in particular, inductors for power supply, an inductor itself is required to be reduced in size, but a dimension of a coil is required to be equal to or larger than a certain dimension in order to maintain performance of the coil. For this reason, as for inductors, in particular, inductors for power supply, in general, a coil dimension is desirably large with respect to a body. Thus, the inductor according to the present embodiment including the protruding portion 50 and the straight portion 52 is desirably formed so as to satisfy any one of the following conditions.

Condition 4

In the plane including the opening end face H2 of the upper stage portion 46, a ratio S2/S1 of an area S2 surrounded by the outer peripheral outline 104 of the wound portion 44 and the outer peripheral outline 132 of the body 2, to an area Si surrounded by the inner peripheral outline 102 of the wound portion 44 is equal to or larger than about 0.9, and less than about 1, preferably equal to or less than about 0.98, and more preferably equal to or less than about 0.96.

Condition 5

In the plane including the opening end face H2 of the upper stage portion 46, a ratio D/F of the width (fourth length) D in the short direction of the outer peripheral outline 104, to the length F in the short direction of the body 2 is equal to or larger than about 0.8, and equal to or less than about 1, preferably equal to or less than about 0.98, and more preferably equal to or less than about 0.96.

Condition 6

In the plane including the opening end face H2 of the upper stage portion 46, a ratio C/E of the width (the third length) C in the long direction of the outer peripheral outline 104, to the length E in the long direction of the body 2 is equal to or larger than about 0.8 and equal to or less than about 0.9 (i.e., from about 0.8 to about 0.9).

Thus, the inductor according to the present embodiment is formed so as to satisfy at least one condition from condition 1 to condition 6.

Note that, in the working examples, the length E in the long direction of the body 2 was set to about 2.06 mm, and the length F in the short direction of the body 2 was set to about 1.35 mm, to perform the simulation, however, a similar relationship can be derived even when the length E in the long direction of the body 2 and the length F in the short direction of the body 2 are changed.

The inductor configured as described above includes the substantially rectangular parallelepiped shaped body 2 including the magnetic base 8 including the base portion 10, and the columnar portion 16 formed on the upper surface 10*a* of the base portion 10, the coil 54 including the wound portion 44 formed by winding the conductive wire having the flat surface portions facing each other at upper and lower two stages around the columnar portion 16 with one of the flat surface portions 64 (or 66) in contact with the side surface of the columnar portion 16, having both ends thereof located on the outer periphery, and having the upper stage portion and the lower stage portion connected with each other by the conductive wire constituting the inner peripheral portion, the extended portion 40 of the pair drawn out from the outer peripheral portion of each the stage portion 46 of the wound portion 44 toward the side surface of the base portion 10 and having the tip portion 40*a* disposed on the lower surface 10*b* of the base portion, and the extended portion 42 of the pair drawn out from the outer peripheral portion of each the stage portion 48 of the wound portion 44 toward the side surface of the base portion 10 and having the tip portion 42*a* disposed on the lower surface 10*b* of the base portion 10, and the magnetic outer coating 6 covering the part of the magnetic base 8, the part of the pair of extended portions 40 and 42, and the wound portion 44, and containing the magnetic powder, and the outer electrodes 4*a* and 4*b* forming the pair disposed on the mounting surface of the body 2, and connected to the extended portions 40 and 42 forming the pair respectively, wherein the shape of the wound portion 44 in plan view seen through from the upper surface of the body is the substantially annular shape having the short direction and the long direction, and the upper stage portion 46 has the protruding portion 50 protruding in the short direction.

5. Effect

The inductor configured as described above has the protruding portion 50 for which the degree of protrusion increases as a distance from the lower stage portion 48 increases, on the upper stage portion 46 of the wound portion 44 of the coil 54. Accordingly, the area (sectional area) of the region surrounded by the inner peripheral outline becomes larger, in the opening end face H2 of the upper stage portion 46 of the wound portion 44, compared to a case in which the protruding portion 50 is not provided. Here, the inductance value L of the inductor is expressed by Equation 1.

$$L = \frac{\kappa \mu S N^2}{l} \quad \text{Equation 1}$$

(κ: Nagaoka coefficient, μ: permeability, S: sectional area of a coil, l: length of the coil)

Thus, since the inductor according to the present embodiment includes the protruding portion 50 on a part of the coil 54, the inductance value L can be improved. Accordingly, with the inductor 1 according to the present embodiment, the inductance value L can be improved, even when a spatial limitation due to respective regions occupied by the extended portions 40 and 42 is present.

Further, the inductor configured as described above has the straight portion 52 that separates from the winding axis B2 as a distance from the lower stage portion 48 increases, on the upper stage portion 46 of the wound portion 44 of the coil 54. Accordingly, the area of the region surrounded by the inner peripheral outline becomes larger, in the opening end face H2 of the upper stage portion 46 of the wound portion 44, compared to a case in which the straight portion 52 is not provided. Thus, since the inductor 1 according to the present embodiment includes the straight portion 52 on a part of the coil 54, the inductance value L can be improved. Accordingly, with the inductor 1 according to the present embodiment, the inductance value L can be improved, even when a spatial limitation due to respective regions occupied by the extended portions 40 and 42 is present.

The inductor configured as described above may be configured such that in the plane including the opening end face H2 of the upper stage portion 46, the ratio A/B is equal to or larger than about 1.7 and equal to or less than about 3 (i.e., from about 1.7 to about 3), preferably equal to or larger than about 2 and equal to or less than about 3 (i.e., from about 2 to about 3), and more preferably equal to or larger than about 2.3 and equal to or less than about 2.6 (i.e., from about 2.3 to about 2.6. In particular, when the length E in the long direction of the body 2 is about 1.4 to about 1.8 mm, and the length F in the short direction of the body 2 is about 0.6 to about 1.0 mm, the ratio is preferably equal to or larger than about 2.3 and equal to or less than about 2.4 (i.e., from about 2.3 to about 2.4), and when the length E in the long direction of the body 2 is about 1.8 to about 2.2 mm, and the length F in the short direction of the body 2 is about 1.0 to about 1.4 mm, the ratio is preferably equal to or larger than about 2.5 and equal to or less than about 2.6 (i.e., from about 2.5 to about 2.6). Thus, the variation in the rated current obtained by the inductance value is reduced, and it is possible to improve a probability that a predetermined rated current can be obtained even when the inductance value varies somewhat.

In addition, the inductor configured as described above may be configured such that, in the plane including the opening end face H2 of the upper stage portion 46, the ratio B/F is equal to or larger than about 0.3 and equal to or less than about 0.6 (i.e., from about 0.3 to about 0.6). In particular, when the length E in the long direction of the body 2 is about 1.4 to about 1.8 mm, and the length F in the short direction of the body 2 is about 0.6 to about 1.0 mm, the ratio is preferably equal to or larger than about 0.5 and equal to or less than about 0.6 (i.e., from about 0.5 to about 0.6), and when the length E in the long direction of the body 2 is about 1.8 to about 2.2 mm, and the length F in the short direction of the body 2 is about 1.0 to about 1.4 mm, the ratio is preferably equal to or larger than about 0.3 and equal to or less than about 0.4 (i.e., from about 0.3 to about 0.4). Accordingly, with the inductor according to the present disclosure, a high inductance value can be obtained, and a rated current can also be increased.

In addition, the inductor configured as described above may be configured such that, in the plane including the opening end face H2 of the upper stage portion 46, the ratio A/E is equal to or larger than about 0.6 and equal to or less than about 0.9 (i.e., from about 0.6 to about 0.9). Accordingly, with the inductor according to the present disclosure, a high inductance value can be obtained, and a rated current can also be increased.

In addition, in the inductor configured as described above may be configured such that, in the plane including the opening end face H2 of the upper stage portion 46, the ratio S2/S1 of the area S2 surrounded by the outer peripheral outline 104 of the wound portion 44 and the outer peripheral outline 132 of the body 2, to the area Si surrounded by the inner peripheral outline 102 of the wound portion 44 is equal to or larger than about 0.9, and less than about 1 (i.e., from about 0.9 to less than about 1). Accordingly, with the inductor according to the present disclosure, desired coil performance (inductance value L) can be maintained even when the inductor is reduced in size.

In addition, the inductor configured as described above may be configured such that, in the plane including the opening end face H2 of the upper stage portion 46, the ratio D/F of the fourth length D, to the length F in the short direction of the body 2 is equal to or larger than about 0.8 and equal to or less than about 1 (i.e., from about 0.8 to less than about 1). Accordingly, with the inductor according to the present disclosure, desired coil performance (inductance value L) can be maintained even when the inductor is reduced in size.

In addition, the inductor configured as described above may be configured such that, in the plane including the opening end face H2 of the upper stage portion 46, the ratio C/E of the third length C, to the length E in the long direction of the body 2 is equal to or larger than about 0.8 and equal to or less than about 0.9 (i.e., from about 0.8 to about 0.9). Accordingly, with the inductor according to the present disclosure, desired coil performance (inductance value L) can be maintained even when the inductor is reduced in size.

Further, in the inductor configured as described above, the columnar portion 16 is disposed on the upper surface 10*a* of the base portion 10 such that the length D1 between the winding axis B1 of the columnar portion 16 and the first side surface 10*c* of the base portion 10 is longer than the length D2 between the winding axis B1 and a third side surface 10*e* of the base portion 10. Thus, a length between the winding axis B2 of the wound portion 44 wound around the columnar portion 16 and the first side surface 10*c* of the base portion 10 is also longer than a length between the winding axis B2 and the third side surface 10*e* of the base portion 10. Accordingly, it is possible to sufficiently secure respective regions in which the extended portions 40 and 42 of the wound portion 44 wound around the columnar portion 16 are twisted on the side of the upper surface 10*a* of the base portion 10. Note that, since the first side surface 10*c* and the third side surface 10*e* of the base portion 10 are exposed from the magnetic outer coating 6, each the side surface can also be said to be a part of the side surface of the body 2.

6. Method for Manufacturing

Next, a method for manufacturing the inductor configured as described above will be described.

The method for manufacturing the inductor includes:

(1) a step for forming the magnetic base 8;

(2) a step for forming the coil 54;

(3) a step for molding and curing;

(4) a step for forming the exterior resin on the body;

(5) a step for removing the exterior resin and the covering layer and the fusion layer of the conductive wire; and (6) a step for forming the outer electrodes 4*a* and 4*b*.

(1) Step for Forming Magnetic Base 8

A mixture of magnetic powder and resin is filled in a cavity of a mold capable of forming the columnar portion 16 and the base portion 10. The mold includes, for example, the cavity having a first portion having a shape and a depth for forming the base portion 10, and a second portion provided on a bottom surface of the first portion and having a shape and a depth for forming the columnar portion. The mixture of the magnetic powder and the resin is pressurized for several seconds to several minutes in the mold, at a pressure of about 1 t/cm$^2$ to about 10 t/cm$^2$, to form the magnetic base. At this time, the magnetic base 8 may be molded by pressurizing the mixture of the magnetic powder and the resin, in a state of being heated to raise temperature to equal to or higher than a softening temperature of the resin (for example, about 60° C. about 150° C.). Next, heating is performed to raise the temperature to equal to or higher than a curing temperature of the resin (for example, about 100° C. to about 220° C.) for curing, thereby obtaining the magnetic base 8 having the base portion 10, and the columnar portion 16 formed on the base portion 10. Note that, semi-curing may be used, and in this case, the semi-curing is performed by adjusting temperature (for example, about 100° C. to about 220° C.) and curing time (about 1 minute to about 60 minutes).

(2) Step for Forming Coil 54

By winding the conductive wire around the columnar portion 16 of the obtained magnetic base 8, the coil 54 having the wound portion 44 and the pair of extended portions 40 and 42 drawn out from the wound portion 44 is formed. As the conductive wire, the rectangular wire having the covering layer, and having the substantially rectangular section is used. Additionally, the wound portion 44 is formed by winding the conductive wire at upper and lower two stages around the columnar portion 16, with one of the flat surface portions of the conductive wire in contact with the side surface of the columnar portion 16, has both the ends of the wound portion located on the outer periphery, and has the upper stage portion and the lower stage portion connected to each other by the conductive wire constituting the inner peripheral portion.

As for the extended portions 40 and 42 forming the pair of the coil 54, by crushing a portion in front of a portion disposed so as to be close to the notch 14 of the base portion 10 of the magnetic base 8, thereby forming the tip portion 40*a* having a flat surface portion that is wider than the conductive wire of the wound portion 44, and by crushing a portion in front of a portion disposed so as to be close to the notch 15 of the base portion 10 of the magnetic base 8, thereby forming the tip portion 42*a* having a flat surface portion that is wider than the conductive wire of the wound portion 44.

The pair of extended portions 40 and 42 of the coil 54 are drawn out from one side surface of the base portion 10 of the magnetic base 8. At this time, the extended portions 40 and 42 forming the pair are each twisted toward a center portion of the base portion 10 of the magnetic base 8, and are drawn out toward the side of the lower surface 10*b* of the base portion 10 such that the flat surface portion 66 on one side contacts an inner surface of the notch 14, and the flat surface portion 66 on one side contacts an inner surface of the notch 15. The tip portions 40*a* and 42*a* of the respective extended portions 40 and 42 drawn out toward the side of the lower surface 10*b* are bent and disposed on the lower surface 10*b* of the magnetic base 8.

(3) Step for Molding and Curing

The magnetic base 8 on which the coil 54 obtained in the above step is attached, in a state in which the lower surface 10*b* of the base portion 10 faces a bottom surface of the cavity, is accommodated in the cavity of the mold having a convex portion in the bottom surface of the cavity, and the lower surface 10*b* of the base portion 10 and the bottom surface of the cavity of the mold are brought into contact with each other. Next, the mixture of the magnetic powder and the resin is filled in the cavity. Further, in a state in which the mixture of the magnetic powder and the resin is heated to raise the temperature to equal to or higher than the softening temperature of the resin (for example, about 60° C. to about 150° C.) in the mold, the mixture is pressurized at about 100 kg/cm$^2$ to about 500 kg/cm$^2$, heated to raise the temperature to equal to or higher than the curing temperature of the resin (for example, about 100° C. to about 220° C.), and is then molded and cured. Accordingly, the magnetic outer coating 6, the coil 54, and the magnetic base 8 are integrated, and the body 2 is formed. Note that, the curing may be performed after the molding.

By the molding and the curing, the magnetic base 8, and the coil 54 wound around the columnar portion 16 of the magnetic base 8 are incorporated, and the recessed portion 12 (standoff) is formed on the mounting surface (the lower surface 10*b* of the base portion 10) thereof.

In addition, when the mixture of the magnetic powder and the resin filled in the mold is pressurized, molded, and cured, the mixture of the magnetic powder and the resin is pressurized at about 100 kg/cm$^2$ to about 500 kg/cm$^2$ in a state in which the mixture of the magnetic powder and the resin is heated by using the mold to raise the temperature to equal to or higher than a softening temperature of both the resin and the fusion layer of the conductive wire (for example, about 60° C. to about 150° C.), and then heating is performed to raise the temperature to equal to or higher than the curing temperature of the resin (for example, about 100° C. to about 220° C.) for the molding and the curing, thus the conductive wire of the upper stage portion 46 and the conductive wire of the lower stage portion 48 of the wound portion 44 of the coil 54 are formed in a mutually nested state. A region in which the conductive wire of the upper stage portion 46 and the conductive wire of the lower stage portion 48 are formed in the nested state needs not to be formed over an entire circumference of the wound portion 44 but may be formed in a part thereof. At this time, the pressuring during the molding forms a portion of the conductive wire of the upper stage portion 46 of the wound portion 44 that is inclined in a direction in which an upper portion of the conductive wire is separated from the winding axis B2. Accordingly, the protruding portion 50 and the straight portion 52 are formed in respective parts of the upper stage portion 46. Further, in the columnar portion 16 of the magnetic base 8 in contact with the inner periphery of the wound portion 44, a tip is thicker than a root portion, and the protruding surface 22 and the flat surface 24 are formed on the side surface.

(4) Step for Forming Exterior Resin on Body

In this step, the exterior resin is formed on an entire surface of the obtained body 2. The exterior resin is formed by applying a thermosetting resin such as an epoxy resin, a polyimide resin, or a phenol resin, or a thermoplastic resin such as a polyethylene resin or a polyamide resin to a surface and curing the resin.

(5) Step for Removing Exterior Resin, and Covering Layer and Fusion Layer of Conductive Wire In the body 2 on which the exterior resin is formed, the exterior resin, and the covering layer and the fusion layer of the conductive wire at each of the positions where the outer electrodes 4*a* and 4*b* are formed respectively are removed. The exterior resin, and the covering layers and the fusion layers of the conductive wires are removed by using a physical method such as laser, blast treatment, and polishing.

(6) Step for Forming Outer Electrode

At the position on the mounting surface of the body 2 where the outer electrode 4*a* is formed, a resin containing silver powder is applied such that the tip portion 40*a* of the extended portion 40 of the coil 54 is covered, and at the position on the mounting surface of the body 2 where the outer electrode 4*b* is formed, the resin containing the silver powder is applied such that the tip portion 42*a* of the extended portion 42 of the coil 54 is covered. At this time, the resin containing the silver powder may be applied such that both end regions of the tip portion 40*a* of the extended portion 40 of the coil 54 are covered, and the central region 40*b* is exposed, and both end regions of the tip portion 42*a* of the extended portion 42 of the coil 54 are covered, and the central region 42*b* is exposed.

The body 2 is plated, and the outer electrodes 4*a* and 4*b* are formed in portions where the exterior resins of the body 2 are removed, respectively. The outer electrodes 4*a* and 4*b* are formed by plating and growing on the metal magnetic powder exposed to the surface of the body 2 and on the resin containing the silver powder. In addition, when the resin containing the silver powder is applied such that both the end regions of the tip portion 40*a* of the extended portion 40 of the coil 54 and both the end regions of the tip portion 42*a* of the extended portion 42 of the coil 54 are covered, and the central regions 40*b* and 42*b* are exposed, the outer electrode 4*a* is formed by plating and growing on the metal magnetic powder exposed to the surface of the body 2, on the resin containing the silver powder, and on the central region 40*b* of the tip portion 40*a* of the extended portion 40 of the coil 54, and the outer electrode 4*b* is formed by plating and growing on the metal magnetic powder exposed to the surface of the body 2, on the resin containing the silver powder, and on the central region 42*b* of the tip portion 42*a* of the extended portion 42 of the coil 54. The plating and growing forms, for example, a nickel layer made of nickel, and then forms a tin layer formed from tin on the nickel layer.

7. Second Embodiment

Figure 13:
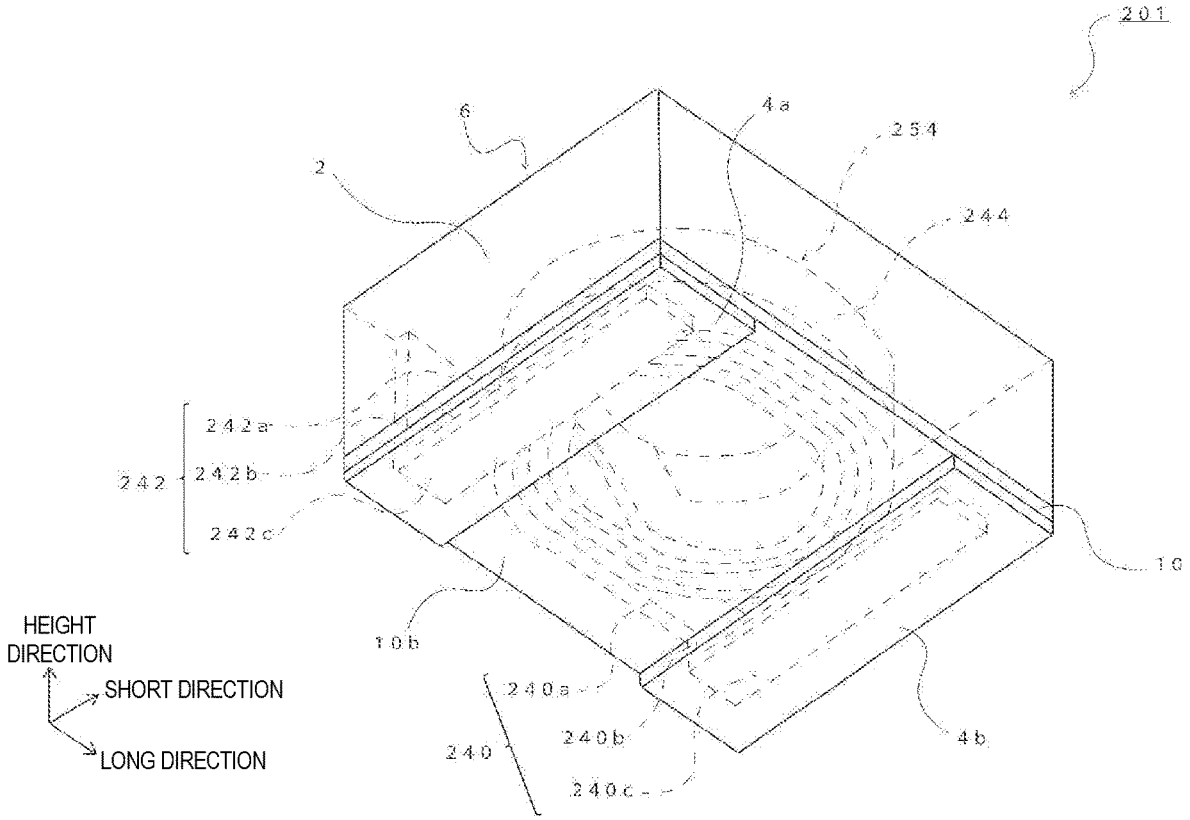
FIG. 13 is a perspective view from below illustrating an inductor according to a second embodiment of the present disclosure.

Next, referring to FIG. 13, an inductor 201 according to a second embodiment will be described. FIG. 13 is a perspective view from below illustrating the inductor 201 according to the second embodiment of the present disclosure. The inductor 201 according to the present embodiment is different from the inductor 1 according to the first embodiment in respective shapes of extended portions 240 and 242 forming a pair.

The extended portion 240 of the pair includes, a first region 240*a* continuous to a wound portion 244, a second region 240*b* continuous to the first region 240*a* and extending between the first region 240*a* and the lower surface 10*b* of the base portion 10, and a third region 240*c* continuous to the second region 240*b* and disposed on the lower surface 10*b* of the base portion 10, and the extended portion 242 of the pair includes a first region 242*a* continuous to the wound portion 244, a second region 242*b* continuous to the first region 242*a* and extending between the first region 242*a* and the lower surface 10*b* of the base portion 10, and a third region 242*c* continuous to the second region 242*b* and disposed on the lower surface 10*b* of the base portion 10. The third region 240*c* corresponds to the tip portion 40*a* of the extended portion 40 in the first embodiment, is exposed from the magnetic outer coating 6, and is connected to the outer electrodes 4*a*, and the third region 242*c* corresponds to the tip portion 42*a* of the extended portion 42 in the first embodiment, is exposed from the magnetic outer coating 6, and is connected to the outer electrodes 4*b*.

An extending direction of the first regions 240*a* and 242*a* and an extending direction of the second regions 240*b* and 242*b* mutually form an angle equal to or larger than about 90 degrees and equal to or less than about 180 degrees (i.e., from about 90 degrees to about 180 degrees) (obtuse angle). Similarly, an extending direction of the second regions 240*b* and 242*b* and an extending direction of the third regions 240*c* and 242*c* mutually form an angle equal to or larger than about 90 degrees and equal to or less than about 180 degrees (i.e., from about 90 degrees to about 180 degrees) (obtuse angle).

Note that, the inductor 201 illustrated in FIG. 13 does not have the recessed portion 12 on the lower surface 10*b* of the base portion 10, but may have the recessed portion 12 in the same manner as the inductor 1 according to the first embodiment.

8. Effect

In the inductor 201 configured as described above, the extended portion 240 is bent a plurality of times, and thus it is possible to reduce a region occupied by the extended portion 240 in the short direction, and the extended portion 242 is bent a plurality of times, and thus it is possible to reduce a region occupied by the extended portion 242 in the short direction. This makes it possible to increase a region occupied by the wound portion 244, and to increase the inductance value L of the inductor 201. Further, by setting the extending direction of the first regions 240*a* and 242*a* and the extending direction of the second regions 240*b* and 242*b* so as to form a right angle or an obtuse angle, and setting the extending direction of the second regions 240*b* and 242*b* and the extending direction of the third regions 240*c* and 242*c* so as to form a right angle or an obtuse angle, it is possible to prevent an excessive load from being applied to the conductive wire, and to prevent damage to the conductive wire.

9. Modification Example

The coils 54 and 254 of the respective inductors 1 and 201 described above each have the substantially elliptical annular shape in plan view, but the present disclosure is not limited thereto. The shape of each of the coils 54 and 254 in plan view may be, for example, an elliptical annular shape, a perfect annular shape, a substantially rectangular annular shape having curved corner portions, or the like.

Further, the inductors 1 and 201 described above each include one number of the protruding portion 50 and one number of the straight portion 52, but the number of the protruding portions 50 and/or the straight portions 52 is not limited thereto. For example, a second protruding portion may be further provided in the second planar region 58, and/or a second straight portion may be further provided in the second curved region 62. As the number of protruding portions and straight portions provided in the wound portion 44 increases, the inductance value L can be improved.

Although the embodiments and working examples of the present disclosure have been described above, the contents disclosed may be changed in details of the configuration, and a combination of elements in the embodiments and working examples, a change in the order, and the like may be realized without departing from the scope and spirit of the claimed present disclosure.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor, comprising:

a body having a substantially rectangular parallelepiped shape, the body including a magnetic base including a base portion and a columnar portion formed on an upper surface of the base portion, a coil including a wound portion including a conductive wire having flat surface portions facing each other at upper and lower two stages wound around the columnar portion with one of the flat surface portions in contact with a side surface of the columnar portion, the wound portion having both ends that are located on an outer periphery and having an upper stage portion and a lower stage portion connected with each other by the conductive wire constituting an inner peripheral portion, a shape of the wound portion in plan view as viewed through from an upper surface of the body is a substantially annular shape having a short direction and a long direction, and the upper stage portion has a protruding portion protruding in the short direction, and a pair of extended portions each extended out from an outer peripheral portion of each stage of the wound portion toward a side surface of the base portion and each having a tip portion disposed on a lower surface of the base portion, and a magnetic outer coating containing magnetic powder and covering a part of the magnetic base, a part of the pair of extended portions, and the wound portion; and a pair of outer electrodes disposed on a mounting surface of the body and connected to the pair of respective extended portions.

2. The inductor according to claim 1, wherein the upper stage portion has a straight portion extending in the short direction.

3. The inductor according to claim 1, wherein in a plane including an opening end face of the upper stage portion, a ratio of a width in the long direction of an inner peripheral outline of the wound portion, to a width in the short direction of the inner peripheral outline of the wound portion is from about 1.7 to about 3.

4. The inductor according to claim 3, wherein in the plane including the opening end face of the upper stage portion, a ratio of a width in the short direction of the inner peripheral outline of the wound portion, to a length in the short direction of the body is from about 0.3 to about 0.6, and a ratio of a width in the long direction of the inner peripheral outline of the wound portion, to a length in the long direction of the body is from about 0.6 to about 0.9.

5. The inductor according to claim 1, wherein in the plane including the opening end face of the upper stage portion, a ratio of an area surrounded by an outer peripheral outline of the wound portion and an outer peripheral outline of the body, to an area surrounded by the inner peripheral outline of the wound portion is from about 0.9 to less than about 1.

6. The inductor according to claim 1, wherein in the plane including the opening end face of the upper stage portion, a ratio of a width in the short direction of the outer peripheral outline of the wound portion, to the length in the short direction of the body is from about 0.8 to about 1, and a ratio of a width in the long direction of the outer peripheral outline of the wound portion, to the length in the long direction of the body is from about 0.8 to about 0.9.

7. The inductor according to claim 1, wherein a length between a winding axis of the wound portion and one side surface extending in the long direction of the body is shorter than a length between the winding axis and another side surface extending in the long direction of the body.

8. The inductor according to claim 1, wherein the extended portion includes a first region continuous to the wound portion, a second region continuous to the first region and extending between the first region and the lower surface of the base portion, and a third region continuous to the second region and disposed on the lower surface of the base portion, and the third region is the tip portion, and is exposed to the mounting surface of the body.

9. The inductor according to claim 1, wherein the pair of outer electrodes include a conductive resin layer containing silver powder, a nickel layer formed on the conductive resin layer, and a tin layer formed on the nickel layer, the tip portion of the extended portion is exposed to the mounting surface, and the conductive resin layer is disposed on the mounting surface and on both end regions of the tip portion, and is disposed in such a shape that a central region of the tip portion sandwiched between both the end regions thereof is exposed.

10. The inductor according to claim 2, wherein in a plane including an opening end face of the upper stage portion, a ratio of a width in the long direction of an inner peripheral outline of the wound portion, to a width in the short direction of the inner peripheral outline of the wound portion is from about 1.7 to about 3.

11. The inductor according to claim 2, wherein in the plane including the opening end face of the upper stage portion, a ratio of an area surrounded by an outer peripheral outline of the wound portion and an outer peripheral outline of the body, to an area surrounded by the inner peripheral outline of the wound portion is from about 0.9 to less than about 1.

12. The inductor according to claim 3, wherein in the plane including the opening end face of the upper stage portion, a ratio of an area surrounded by an outer peripheral outline of the wound portion and an outer peripheral outline of the body, to an area surrounded by the inner peripheral outline of the wound portion is from about 0.9 to less than about 1.

13. The inductor according to claim 4, wherein in the plane including the opening end face of the upper stage portion, a ratio of an area surrounded by an outer peripheral outline of the wound portion and an outer peripheral outline of the body, to an area surrounded by the inner peripheral outline of the wound portion is from about 0.9 to less than about 1.

14. The inductor according to claim 2, wherein in the plane including the opening end face of the upper stage portion, a ratio of a width in the short direction of the outer peripheral outline of the wound portion, to the length in the short direction of the body is from about 0.8 to about 1, and a ratio of a width in the long direction of the outer peripheral outline of the wound portion, to the length in the long direction of the body is from about 0.8 to about 0.9.

15. The inductor according to claim 3, wherein in the plane including the opening end face of the upper stage portion, a ratio of a width in the short direction of the outer peripheral outline of the wound portion, to the length in the short direction of the body is from about 0.8 to about 1, and a ratio of a width in the long direction of the outer peripheral outline of the wound portion, to the length in the long direction of the body is from about 0.8 to about 0.9.

16. The inductor according to claim 2, wherein a length between a winding axis of the wound portion and one side surface extending in the long direction of the body is shorter than a length between the winding axis and another side surface extending in the long direction of the body.

17. The inductor according to claim 3, wherein a length between a winding axis of the wound portion and one side surface extending in the long direction of the body is shorter than a length between the winding axis and another side surface extending in the long direction of the body.

18. The inductor according to claim 2, wherein the extended portion includes a first region continuous to the wound portion, a second region continuous to the first region and extending between the first region and the lower surface of the base portion, and a third region continuous to the second region and disposed on the lower surface of the base portion, and the third region is the tip portion, and is exposed to the mounting surface of the body.

19. The inductor according to claim 3, wherein the extended portion includes a first region continuous to the wound portion, a second region continuous to the first region and extending between the first region and the lower surface of the base portion, and a third region continuous to the second region and disposed on the lower surface of the base portion, and the third region is the tip portion, and is exposed to the mounting surface of the body.

20. The inductor according to claim 2, wherein the pair of outer electrodes include a conductive resin layer containing silver powder, a nickel layer formed on the conductive resin layer, and a tin layer formed on the nickel layer, the tip portion of the extended portion is exposed to the mounting surface, and the conductive resin layer is disposed on the mounting surface and on both end regions of the tip portion, and is disposed in such a shape that a central region of the tip portion sandwiched between both the end regions thereof is exposed.

* * * * *